US006008787A

United States Patent [19]

Kondoh

[11] Patent Number: 6,008,787

[45] Date of Patent: Dec. 28, 1999

[54] ANTIFERROLECTRIC LIQUID CRYSTAL PANEL AND METHOD FOR DRIVING SAME

[75] Inventor: Shinya Kondoh, Tokorozawa, Japan

[73] Assignee: Citizen Watch Co., Ltd., Tokyo, Japan

[21] Appl. No.: 08/750,360

[22] PCT Filed: Apr. 7, 1995

[86] PCT No.: PCT/JP95/00697

§ 371 Date: Dec. 6, 1996

§ 102(e) Date: Dec. 6, 1996

[51] Int. Cl.[6] ..... G09G 3/36

[52] U.S. Cl. ..... 345/97; 349/174

[58] Field of Search ..... 345/94, 95, 96, 345/97, 208, 209, 210; 349/174

[56] References Cited

U.S. PATENT DOCUMENTS

| | | | |
|---|---|---|---|
| 5,078,477 | 1/1992 | Jono et al. | 349/174 |
| 5,367,391 | 11/1994 | Johno et al. | 359/56 |
| 5,459,481 | 10/1995 | Tanaka et al. | 345/95 |
| 5,481,320 | 1/1996 | Konuma et al. | 348/751 |
| 5,482,651 | 1/1996 | Mineta et al. | 252/299.61 |
| 5,546,208 | 8/1996 | Shimizu et al. | 349/155 |
| 5,594,569 | 1/1997 | Konuma et al. | 349/122 |
| 5,615,026 | 3/1997 | Koden | 349/174 |
| 5,631,752 | 5/1997 | Tanaka | 349/173 |

FOREIGN PATENT DOCUMENTS

| | | |
|---|---|---|
| 6-95624 | 4/1994 | Japan . |
| 6-202078 | 7/1994 | Japan . |
| 6-214215 | 8/1994 | Japan . |
| 7-20830 | 1/1995 | Japan . |
| 7-28432 | 1/1995 | Japan . |

*Primary Examiner*—Amare Mengistu
*Assistant Examiner*—Ricardo Osorio
*Attorney, Agent, or Firm*—Finnegan, Henderson, Farabow, Garrett & Dunner, L.L.P.

[57] ABSTRACT

In the driving of an antiferroelectric liquid crystal panel in which an antiferroelectric liquid crystal is inserted between a pair of substrates having a plurality of scanning electrodes and signal electrodes on the opposing surfaces thereof and there are arranged matrix forming pixels, by providing the period for bringing all the pixels simultaneously to the antiferroelectric state each time the display state of any one of the pixels is changed, the setting to the antiferroelectric state is completely carried out so that the period required for the writing of the pixels can be reduced, even if the length of the selection period for setting to the antiferroelectric state is the same as that of the selection period for setting to the ferroelectric state.

8 Claims, 17 Drawing Sheets

ANTIFERROLECTRIC LIQUID CRYSTAL PANEL AND METHOD FOR DRIVING SAME

TECHNICAL FIELD

The present invention relates to an antiferroelectric liquid crystal panel used for a liquid crystal display panel, a liquid crystal optical shutter array, and the like, and a method for driving the antiferroelectric liquid crystal panel, more particularly to an antiferroelectric liquid crystal panel using antiferroelectric liquid crystal and having matrix-forming pixels.

BACKGROUND ART

An antiferroelectric liquid crystal panel is known as having a wide angle of view, a capability of a high speed response, and a good multiplex characteristic, and the studies of the antiferroelectric liquid crystal panel have been energetically carried out. Reference can be made to Japanese Unexamined Patent Publication (Kokai) No. 2-173724.

An antiferroelectric liquid crystal panel has a hysteresis characteristic regarding light transmittance versus applied voltage. Accordingly, when a voltage is applied to an antiferroelectric liquid crystal panel, if the product of the applied voltage and the applied pulse width exceeds a threshold value, a ferroelectric state as the first stable state is selected, if the polarity of the applied voltage is changed, a ferroelectric state as the second stable state is selected, and if the product of the applied voltage and the applied pulse width is below the threshold value, an antiferroelectric state as the third stable state is selected. An example of the characteristic regarding light transmissivity versus applied voltage is shown in FIG. 1. An example of an electrode of an antiferroelectric liquid crystal panel having matrix-forming pixels is shown in FIG. 2. Generally in such an antiferroelectric liquid crystal panel, time-divisional driving is adopted in which the scanning voltages are successively cyclically applied to the scanning electrodes Y1 to Y128, predetermined signal voltages are applied in parallel in synchronization with the scanning voltages to the signal electrodes X1 to X160, and the liquid crystal molecules of the selected pixel are switched in correspondence with the display information.

Various methods of time-divisional driving have been proposed. Examples of the proposed methods are shown in FIGS. 3 and 4. To write one picture plane, the writing of two frames is carried out in which the voltage values of the waveforms of the first frame and the second frame are symmetrical regarding the zero voltage value, so that an alternation of the operation is achieved. The ON state is shown in FIG. 3, and the changes of the voltage and the light transmissivity of pixels at the time of setting the OFF state are shown in FIG. 4. The scanning voltage applied to the scanning electrode consists of three phases in which in the first phase resetting to the OFF state, i.e. the antiferroelectric state, is carried out, in the second phase the state in the first phase is maintained, and in the third phase selecting whether or not the setting to the ON state, i.e. the ferroelectric state is carried out. In the case of FIG. 3, the setting to the ON state, i.e. the ferroelectric state, is carried out, since the third phase of the resultant voltage as the difference between the scanning voltage and the signal voltage exceeds the threshold voltage, while in the case of FIG. 4, the OFF state, i.e. the antiferroelectric state, is maintained, since the third phase does not exceed the threshold voltage.

One of the problems in an antiferroelectric liquid crystal panel is that the response speed of switching from the ferroelectric state to the antiferroelectric state is twice as slow as that of switching from the antiferroelectric state to the ferroelectric state. Therefore, in the prior art method of driving, the period for resetting to the antiferroelectric state is made longer than the period for setting to the ferroelectric state or the antiferroelectric state. However, if the number of the scanning electrode is increased, an disadvantage will occur that the time for writing all the pixels is very much extended. An object of the present invention is to solve the disadvantages in the prior art antiferroelectric liquid crystal panel.

Also, from one of the viewpoints, if the same display is carried out for a long time according to the prior art driving method, some pixels enter the ferroelectric liquid crystal state while other pixels never enter the ferroelectric liquid crystal state, and, when these pixels are switched to the antiferroelectric liquid crystal state, the difference between the layer structures of these pixels appears. This is because the pixels have different layer structures. As a result, the difference between the light transmittances occurs so that a disadvantage of a residual image is brought about. An object of the present invention is to provide an antiferroelectric liquid crystal panel, having matrix-forming pixels, in which the residual image phenomena caused by the difference between the layer structures of the pixels is prevented to ensure a satisfactory display.

Also, from another viewpoint, in order to carry out a satisfactory time-divisional driving in the driving of a liquid crystal display, where the scanning side voltage value of the phase for determining the display state is assumed to be $V_C$ and the signal side voltage value is assumed to be $V_D$, it is necessary concerning the setting of the voltage to satisfy regarding the first scanning period the relationships:

$$|V_C|+V_D|\geqq V5$$

and $$0\leqq||V_C-|V_D||\leqq V1$$

and, in the time-divisional driving, since the driving is carried out under the condition: $V_C>V_D$, the range of the value of $V_D$ is considerably limited based on the above-indicated relationships in the case where the liquid crystal material having a large difference between V1 and V5 is used, since the driving is carried out under the condition: $V_C>V_D$ (see FIG. 1). Accordingly, in the case where the liquid crystal material having a large difference between V1 and V5, the range of the setting of the voltage is limited within a considerably narrow allowance, and thus the satisfactory display cannot be realized. An object of the present invention is to set the range of the voltage value during the non-selection period broader than the range in the case of the prior art, and to provide a method for driving an antiferroelectric liquid crystal capable of displaying easily and satisfactorily even if the liquid crystal material has a large difference between V1 and V5.

Also, from another viewpoint, there is a premise that a molecule of an antiferroelectric liquid crystal has three stable states, in which when no voltage is applied the state is the third stable state as an antiferroelectric state, and when a voltage higher than the threshold voltage Vth is applied the switching to the first stable state as a ferroelectric state or to the second stable state as a ferroelectric state, is carried out depending on the polarity of the applied voltage. In the prior art method for the driving, to switch from the ferroelectric state to the antiferroelectric state, the supplied voltage is made 0 volt to cause to switch according to the nature, e.g.

the viscosity, of the liquid crystal itself without any application of external forces, and accordingly the response speed from the ferroelectric state to the antiferroelectric state is very low. In the prior art method for the driving, the resetting to the antiferroelectric state is necessarily carried out in the first half of the first phase S1 of the selection period consisting of the first (S1), the second (S2), and the third (S3) phases, and then a selection is made whether the bringing to the ferroelectric state or the bringing to the antiferroelectric state is carried out by the select pulse in the third phase S3 (see FIG. 18). In this method, as described above, the response speed of the antiferroelectric liquid crystal from the ferroelectric state to the antiferroelectric state is low, the bringing to the complete antiferroelectric state cannot take place, if the first phase S1 as the period for the resetting is short, to prevent the satisfactory display. Accordingly, the selection period is required to be sufficiently long, the frame frequency is required not to be so high, the period of the writing to the display plane must be extended, and the driving at the video rate becomes difficult. An object of the present invention is to carry out the resetting to the antiferroelectric state, at a high speed, perfectly, and to provide a driving method for an antiferroelectric liquid crystal element capable of high speed driving.

Also, from a further viewpoint, there is a premise that a molecule of an antiferroelectric liquid crystal has three stable states, in which, when no voltage is applied the state is the third stable state as an antiferroelectric state, and when a voltage having the absolute value higher than the threshold voltage Vs is applied the switching to the first stable state as a ferroelectric state or to the second stable state as a ferroelectric state, switching is carried out depending on the polarity of the applied voltage. The switching from the ferroelectric state to the antiferroelectric state is very slow. An object of the present invention is to carry out perfect resetting to the antiferroelectric state in the selection period, and to provide a driving method for an antiferroelectric liquid crystal element capable of a high speed display.

DISCLOSURE OF THE INVENTION

According to the present invention, there is provided a method for driving an antiferroelectric liquid crystal panel which holds an antiferroelectric liquid crystal between a pair of substrates having on opposite surfaces thereof a plurality of scanning electrodes and signal electrodes and has matrix-forming pixels, characterized in that there is provided a period for bringing simultaneously all the pixels simultaneously to the antiferroelectric state each time the display state of any of the pixels is changed.

According to the present invention, there is also provided an antiferroelectric liquid crystal panel which holds an antiferroelectric liquid crystal between a pair of substrates having on opposite surfaces thereof a plurality of scanning electrodes and signal electrodes and has matrix-forming pixels, characterized in that the antiferroelectric liquid crystals of all the pixels are brought to the ferroelectric liquid crystal state during a predetermined period.

According to the present invention, there is also provided a method for driving an antiferroelectric liquid crystal panel which holds an antiferroelectric liquid crystal between a pair of substrates having on opposite surfaces thereof a plurality of scanning electrodes and signal electrodes and has matrix-forming pixels, characterized in that the actual driving of the liquid crystal unit is constituted by at least two scanning periods, each scanning period includes at least two periods: a selection period and a non-selection period, the voltage Vu of the upper limit of the pulse wave applied during the non-selection period is set in the range between the voltage V1 at which the transmittance starts increasing when a voltage having the same polarity as that of the pulse wave is applied to the antiferroelectric liquid crystal unit and the applied voltage is increased and the voltage V2 at which the transmittance starts decreasing, when the applied voltage is decreased, i.e. $V2 \leqq Vu \leqq V1$, and the voltage Vd of the lower limit of the pulse wave is set in the range between the voltage V3 at which the transmittance starts increasing when the absolute value of the voltage having the polarity opposite to that of the voltage V1 is increased and the value V1, i.e. $V3 \leqq Vd \leqq V1$.

According to the present invention, there is also provided a method for driving an antiferroelectric liquid crystal panel in which at least a first scanning period and a second scanning period are provided, the voltage waveforms in said first scanning period and in said second scanning period are symmetrical with regard to 0 volt, and each of the first and second scanning periods has at least a selection period and a non-selection period, characterized in that a reset pulse is applied to the scanning electrodes at the first phase of the selection period and a select pulse is applied to the scanning electrodes in the second phase of said selection period, the polarity of the voltage of the reset pulse is the same as that of the threshold voltage for changing the one ferroelectric state immediately preceding the selection period to the other ferroelectric state, the absolute value of the voltage of the reset pulse is higher than 0 volt and lower than the absolute value of the threshold voltage, and the polarities of the reset pulse and the select pulse in the selection period are the same.

According to the present invention, there is also provided a method for driving an antiferroelectric liquid crystal panel in which at least a first scanning period and a second scanning period are provided, the voltage waveforms in said first scanning period and in said second scanning period are symmetrical with regard to 0 volt, and each of said first scanning period and said second scanning period has at least a selection period and a non-selection period, characterized in that the selection period has a first, a second, and a third phases, a reset pulse is applied to the scanning electrode in the first phase of the selection period, a base voltage is applied to the scanning electrode in the second phase of the selection period, a select pulse is applied to the scanning electrode in the third phase of the selection period, the polarity of the voltage of the reset pulse is the same as that of the threshold voltage for changing the one ferroelectric state preceding to the selection period to the other ferroelectric state, the absolute value of the reset pulse is higher than 0 volt and lower than the absolute value of the threshold voltage, the voltage Vbx of the base voltage is given by the inequality: $V3<Vbx<V1$, where V1 is the voltage at which the transmittance starts increasing when a positive voltage is applied to the antiferroelectric liquid crystal element and V3 is the voltage at which the transmittance starts increasing when a negative voltage is applied thereto, and the polarities of the reset pulse and the select pulse in the same selection period are the same.

In a method for driving an antiferroelectric liquid crystal panel according to the present invention, all the pixels are simultaneously reset each time a pixel is rewritten, after that the writing is carried out for each line of the scanning electrodes, and accordingly the driving waveforms for setting the ferroelectric state or the antiferroelectric state are successively applied to the pixels. Since the period for simultaneously setting all the pixels is provided, the reset period for an individual writing is either unnecessary or is only required to be short. Also, since the writing period itself for one line of the electrode is reduced, the period for writing all the pixels can be reduced even if the number of the scanning electrodes is increased.

BEST MODE FOR CARRYING OUT THE INVENTION

Figure 5:
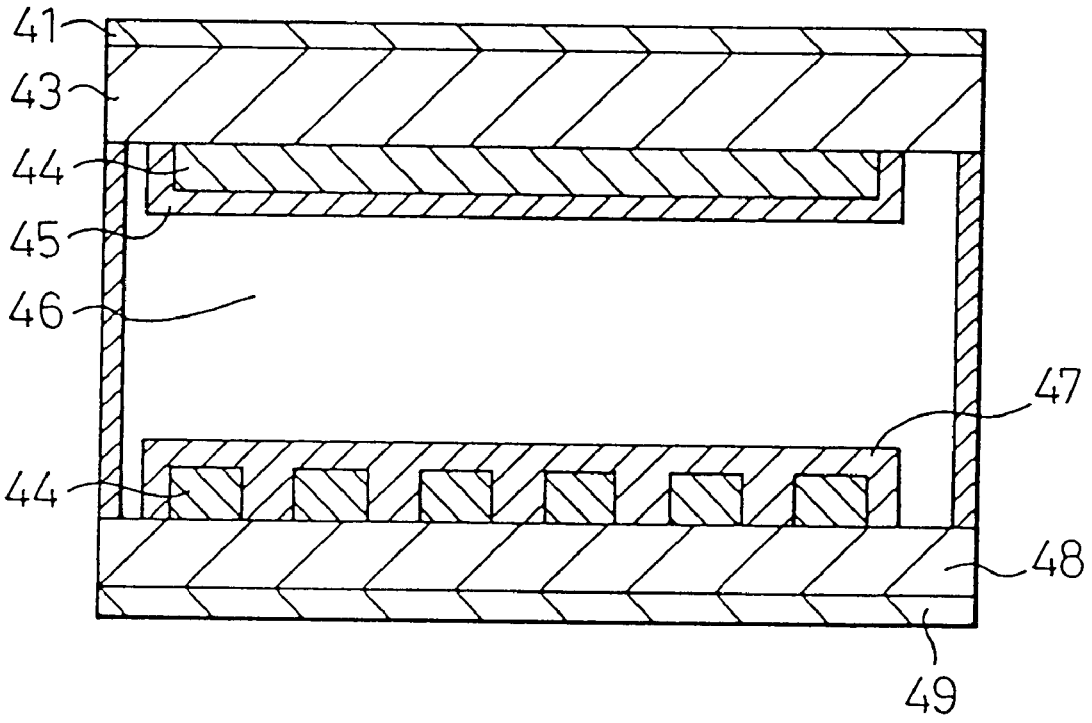
FIG. 5 is a cross-sectional view of a liquid crystal panel according to an embodiment of the invention.

The cross-sectional view of an antiferroelectric liquid crystal panel according to an embodiment of the present invention is shown in FIG. 5. The antiferroelectric liquid crystal panel is constituted by putting an antiferroelectric liquid crystal 46 between a pair of substrates 43 and 48 to form the layer having the thickness of approximately 2 $\mu$m. The electrodes 44 are formed on the opposite surfaces of the substrates 43 and 48, and the orientation coatings 45 and 47 are arranged on the electrodes. On the outside of one substrate 43, the first polarization plate 41 is arranged so that the polarization axis of the polarization plate is parallel with the orientation processing directions of the orientation coatings 45 and 47, while on the outside of the other substrate 48, the second polarization plate 49 is arranged so that the polarization axis is 90° away from that of the first polarization plate 41.

Figure 6:
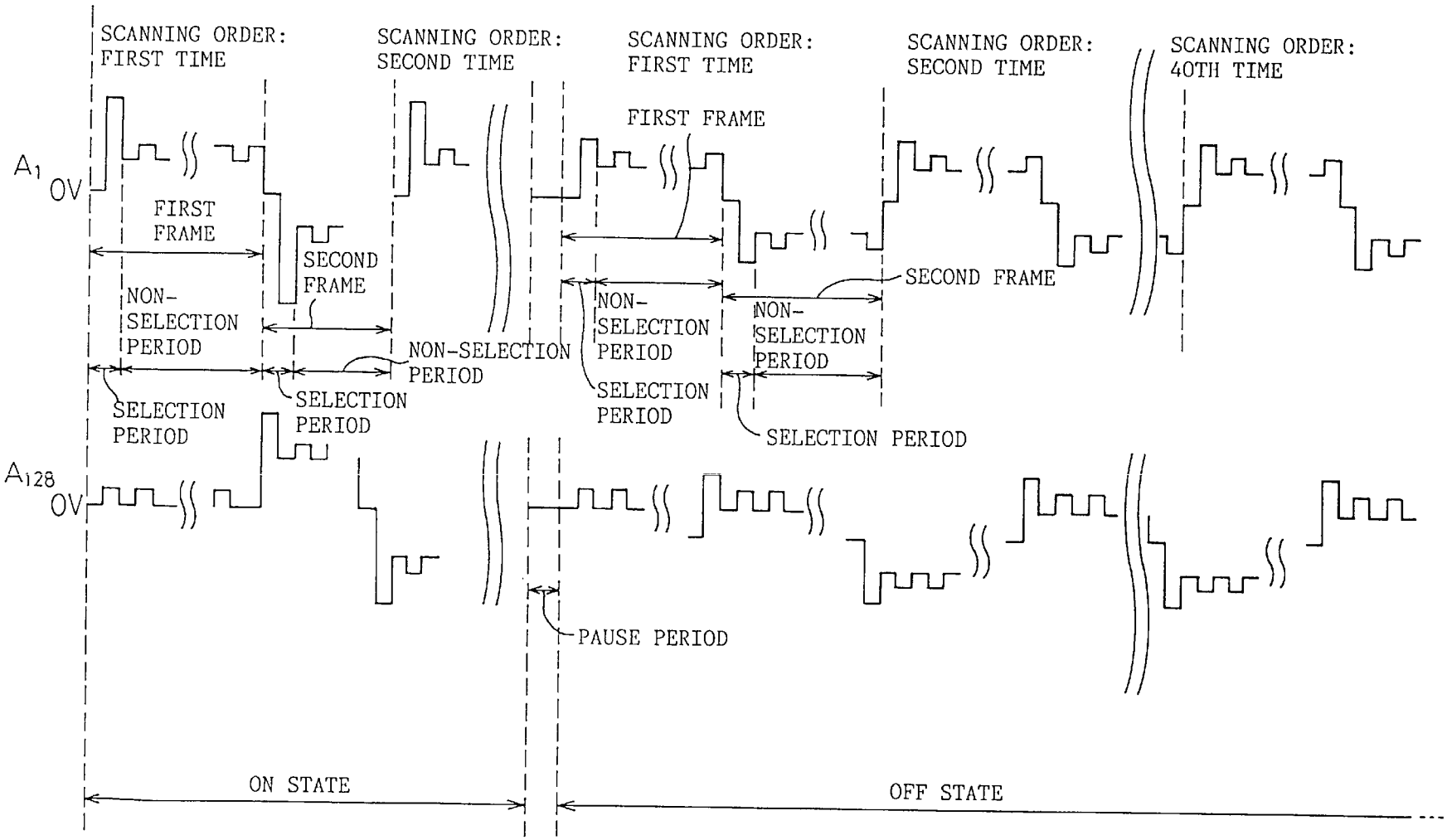
FIG. 6 shows an example of the waveform of the driving voltage applied to the liquid crystal panel pixel.

An example of the waveform of the driving voltage applied to the pixel of the liquid crystal panel of FIG. 5 is shown in FIG. 6. For the liquid crystal panel, an antiferroelectric liquid crystal panel having 128 scanning electrodes and 160 signal electrodes is used. A1 and A128 in FIG. 6 correspond to the pixel A1 and the selection period consists of 2 pulses. One scanning is constituted by 2 frames. The voltage of the first frame and the voltage of the second frame are symmetrical with each other with regard to 0 volt. In the case of displaying the ON state, the voltage of the second phase in the first frame selection period is 30V, and the voltage of the second phase in the second frame selection period is −30V, and in the case of displaying the OFF state, the voltage of the second phase in the first frame selection period is 26V, and the voltage of the second phase in the second frame selection period is −26V. Under this condition, the driving is carried out with approximate 80 ms of the scanning period of one picture. In this case, two display pictures are alternately displayed, and the pause period in which the voltage applied to all the pixels are made 0 volt is provided, as shown in FIG. 6, in which the pause period is made 500 $\mu$s. In this case, for displaying one picture based on approximately 3 seconds of the display period of one picture, 40 scannings are carried out.

In the case where the driving waveforms for selecting the ON state are applied to every pixel, since the voltage of the first phase of the first frame is 0 volt, the resetting to the antiferroelectric state as an OFF state is carried out, and since the voltage of the second phase exceeds the threshold voltage for switching to the ferroelectric state, the setting to the ferroelectric state as an ON state is carried out. In the case where the driving waveforms for selecting the OFF state are applied to every pixel, since the voltage of the first phase of the selection period is 0 volt, the resetting firstly to an OFF state is carried out, and, since the subsequent second phase does not exceed the threshold voltage for setting the ferroelectric state, the antiferroelectric state as the OFF state is maintained.

In the case of the driving method illustrated in FIG. 5 and FIG. 6, when a new display is carried out, since there exists approximate 500 $\mu$s pause period where the voltage applied to all the pixels is 0 volt, it is possible to completely reset, during this period, all the pixels from the ferroelectric state to the antiferroelectric state. Accordingly, even if the pulse width for setting the ferroelectric state is equal to that for setting the antiferroelectric state, it is possible to carry out the driving satisfactorily. On the contrary, in the prior art driving method, in the case where the pixels displaying the ON state are reset to the OFF state, if the pulse width for setting the antiferroelectric state is equal to that for setting the ferroelectric state, it is not possible to satisfactorily reset from the ferroelectric state to the antiferroelectric state only by the first phase of the selection pulse.

In the driving method illustrated in FIG. 5 and FIG. 6, a period is provided in which all the pixels are simultaneously turned to the antiferroelectric state each time the re-writing of the pixel is carried out. Due to this, it is possible to make the pulse width for selecting the antiferroelectric state to be the same as the pulse width for selecting the ferroelectric state, and it is possible to prevent the write period from becoming extensively long and ensure appropriate driving, even if the number of the scanning electrode is increased.

Figure 7:
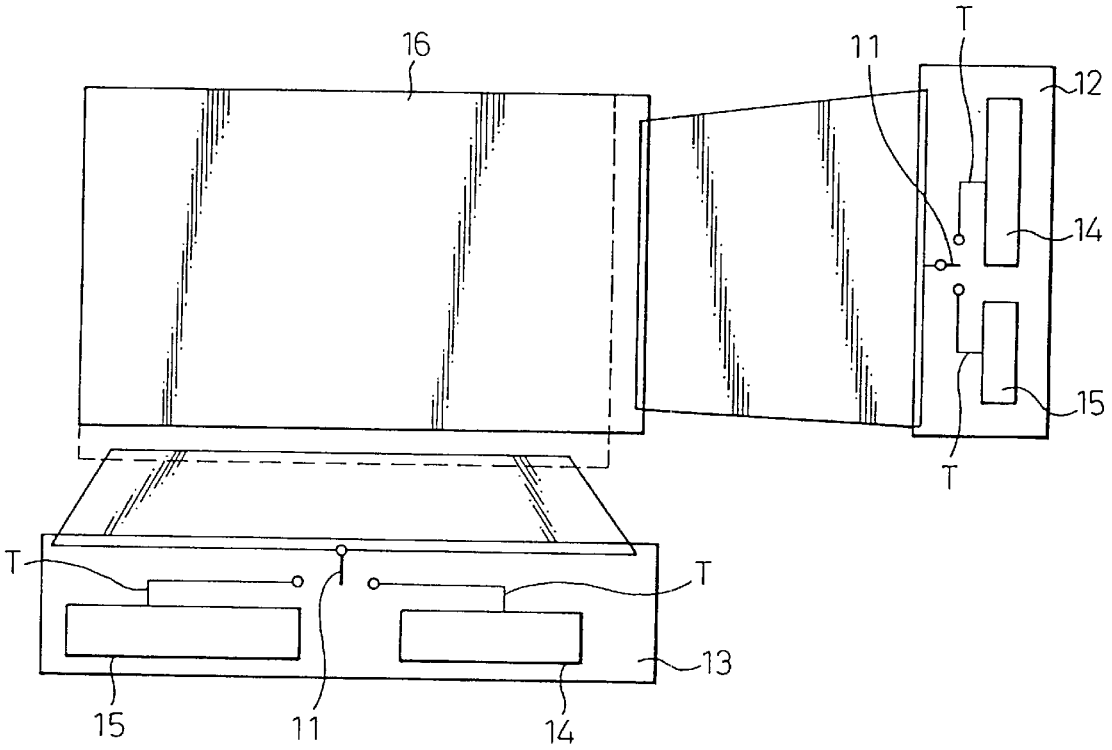
FIG. 7 shows a liquid crystal panel according to an embodiment of the invention.

The antiferroelectric liquid crystal panel according to another embodiment of the present invention is shown in FIG. 7. Regarding the liquid crystal panel, the scanning side driving circuit 12 and the signal side driving circuit 13 are electrically connected to the antiferroelectric crystal panel 16, and, to output two different waveforms, the driving circuit is constituted by the display driving waveform outputting circuit 14 and the layer structure controlling output circuit 14 and the layer structure controlling output circuit 15 for controlling the smectic layer in the cell. The output switching switch 11 is provided in the output portion of the two waveforms, so that the outputting from either of the sides is optionally selected. The waveform output terminal T is provided. Accordingly, by applying the layer structure controlling waveforms to the liquid crystal cell for several seconds after carrying out the same display, it is possible to make all the pixels ferroelectric liquid crystal state, to make the layer structure of all the pixels to become the same, and thus to prevent the residual image phenomena caused by the difference in the layer structures from occurring.

Figure 2:
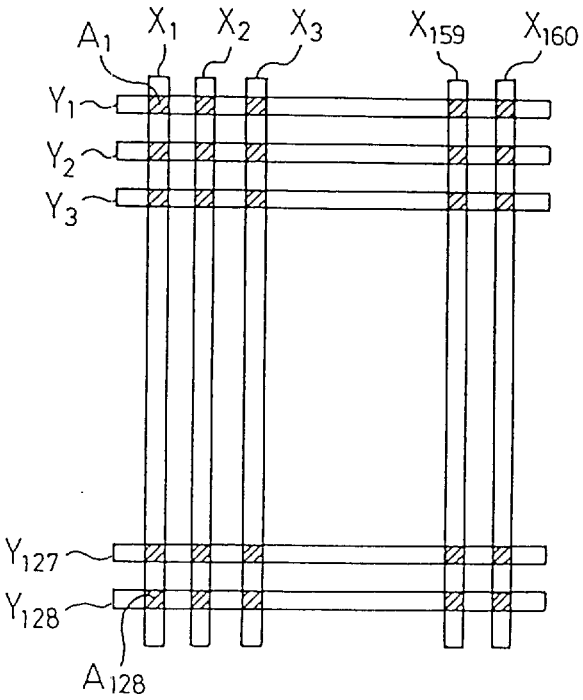
FIG. 2 shows an example of an electrode of an antiferroelectric liquid crystal panel having matrix-forming pixels.
Figure 8:
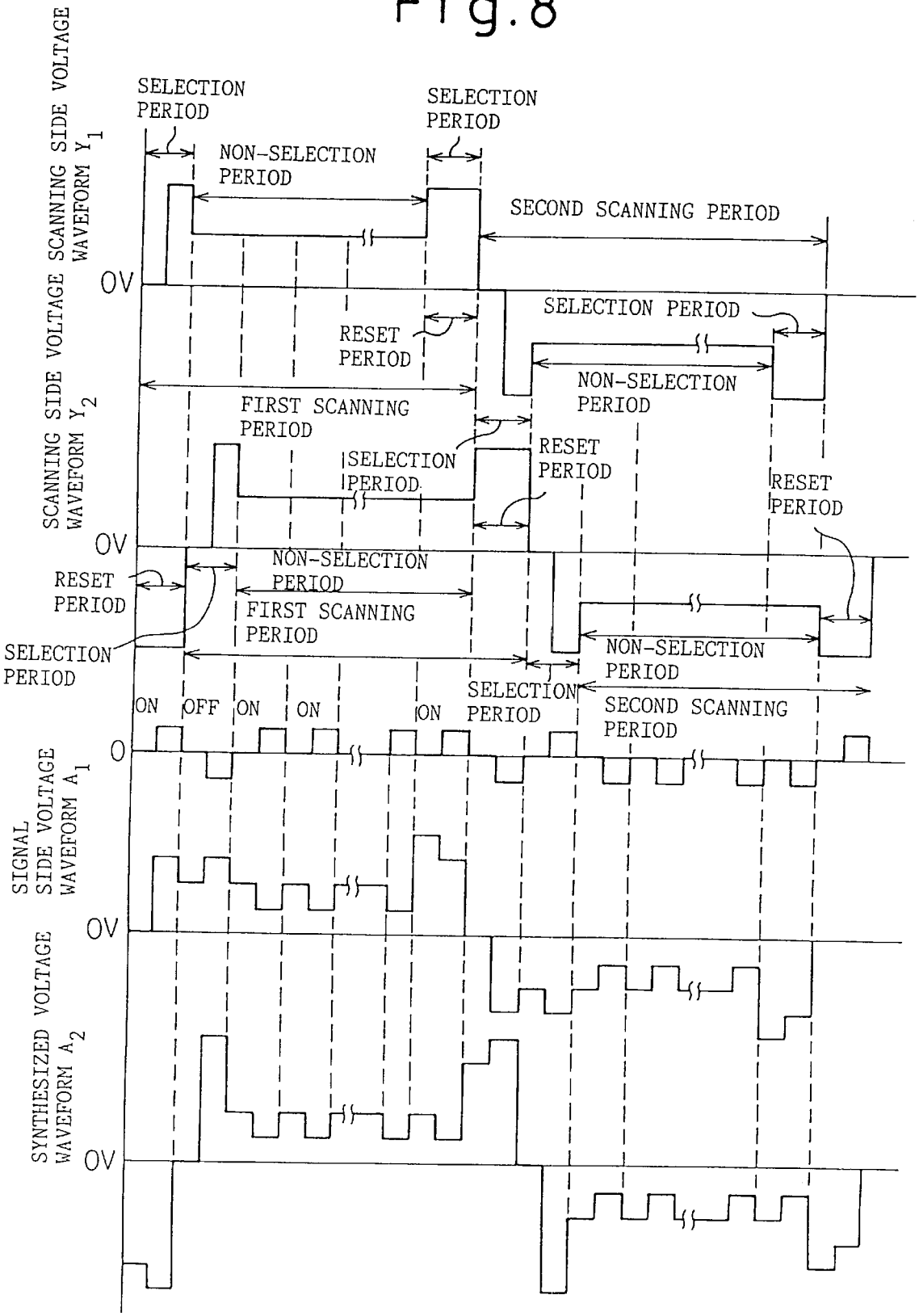
FIG. 8 shows the waveform of the driving voltage of a liquid crystal panel according to an embodiment of the invention.

The driving waveforms for the antiferroelectric liquid crystal panel according to another embodiment of the present invention are shown in FIG. 8. Liquid crystal cells having 128 scanning side electrodes and 160 signal side electrodes are used (FIG. 2, FIG. 5). Y1 and Y2 in FIG. 8 correspond to Y1 and Y2 in FIG. 2. In the driving waveform, one selection period is constituted by 2 pulses. One scanning is constituted by 2 scanning periods, and the voltage in the first scanning period and that in the second scanning period are symmetrical with regard to 0 volt. The voltage applied to the scanning electrode is 0 volt in the first phase of the selection period of the first scanning period, 30V in the second phase, 30V in two phases preceding the next selection period as the reset period, and 10V in the remaining non-selection period. The voltage applied to the scanning electrode is 0 volt in the first phase of the selection period of the second scanning period, −30V in the second phase, −30V in two phases preceding the next selection period as the reset period, and −10V in the remaining non-selection period. The voltage applied to the signal side electrode is 0 volt in the first phase of the ON state in synchronization with the scanning electrode side, and 6V in the second phase. The voltage applied to the signal side electrode is 0 volt in the first phase of the OFF state, and −6V in the second phase. The driving is carried out with the frame frequency of approximately 60 ms.

Without depending on the signal electrode in the ON or OFF state, the liquid crystal in the pixel portion is necessarily reset to the ferroelectric state during the reset period, and subsequently in the selection period it is selected whether the ON state or the OFF state. Accordingly, since no difference in the layer structure exists between the pixels, no residual phenomena takes place even if a new display is written.

Figure 3:
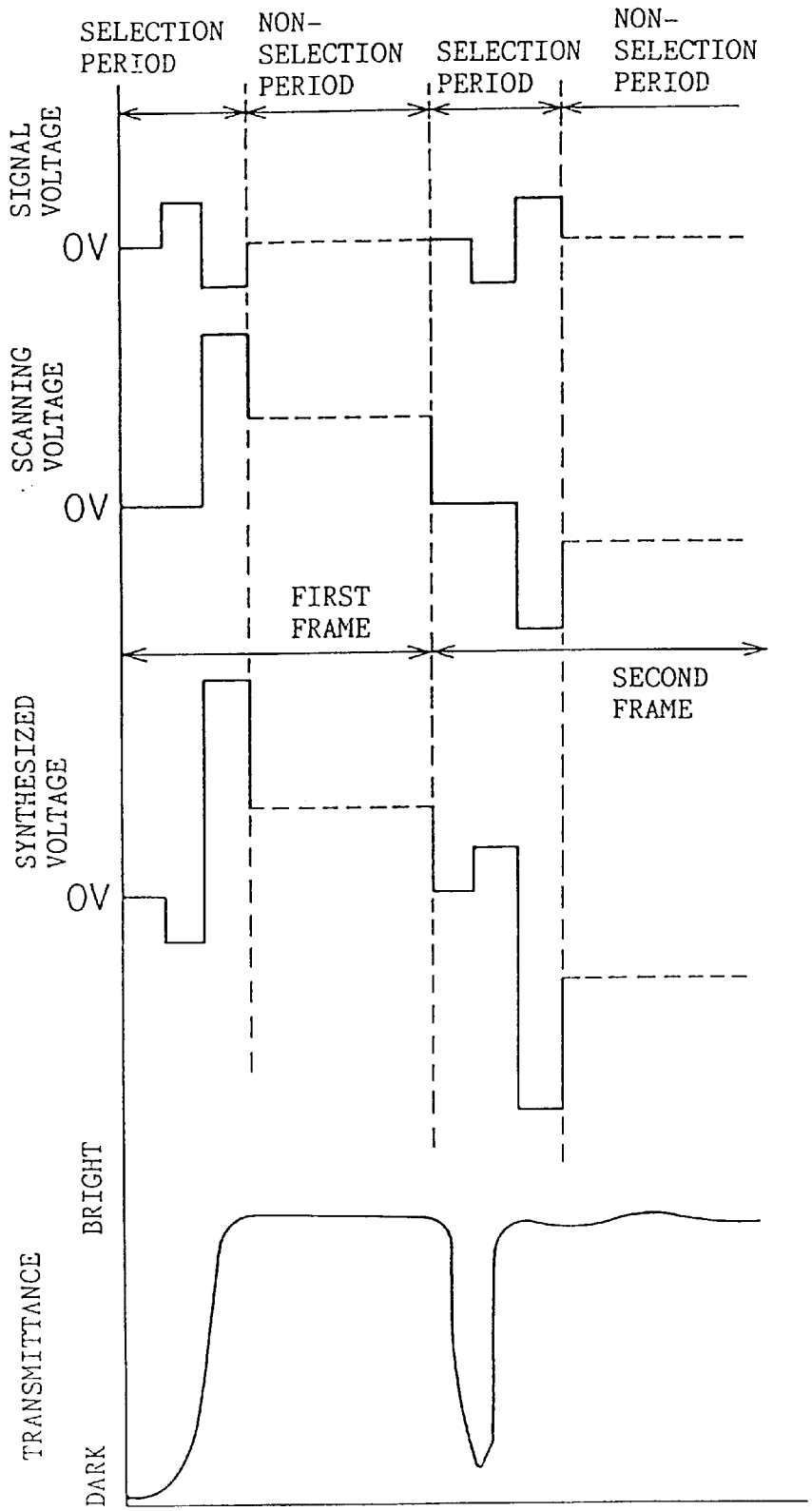
Fig. 3 PRIOR ART
FIGS. 3 and 4 show an example of the prior art time-divisional driving method.
Figure 4:
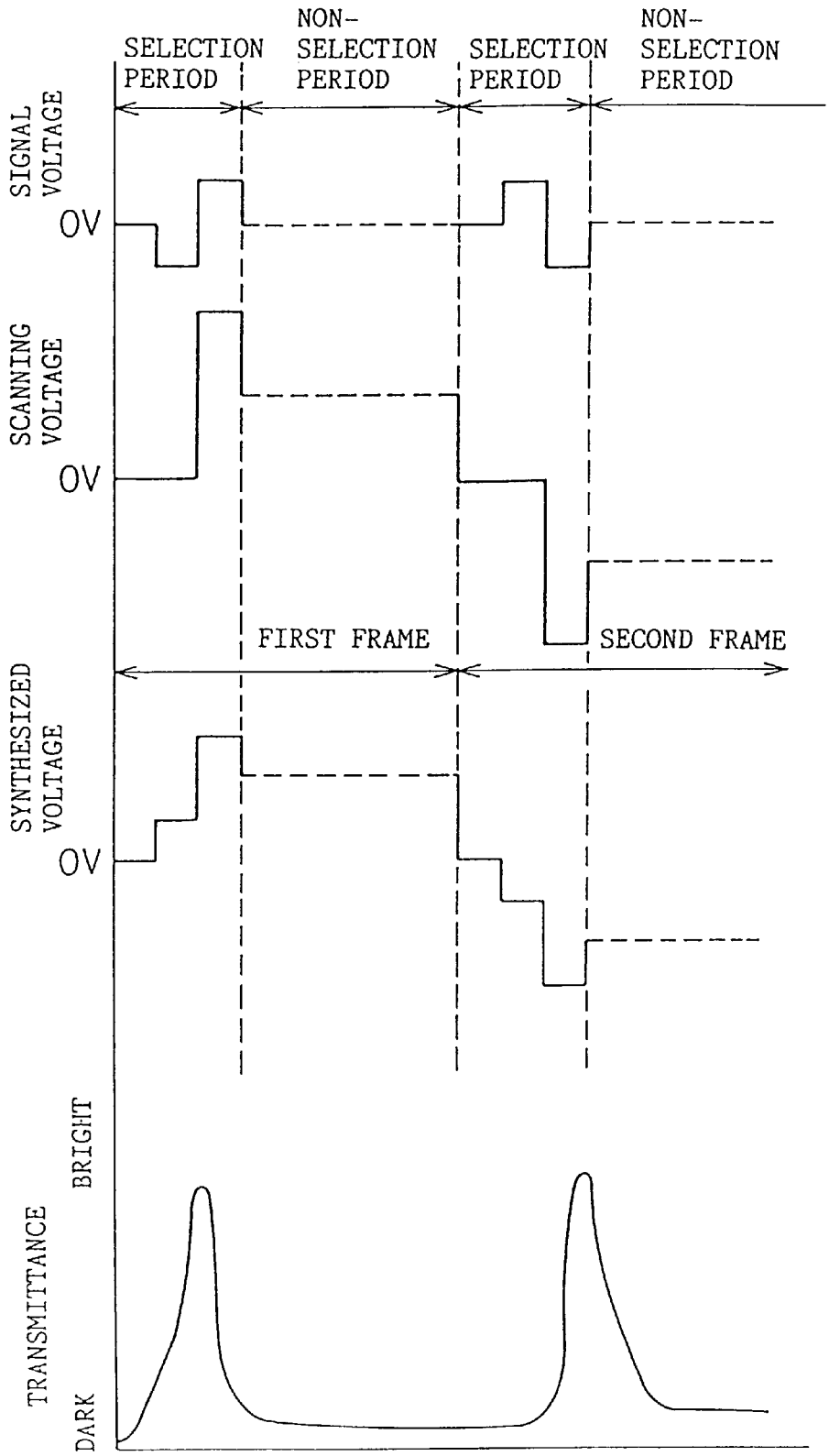
Fig. 4 PRIOR ART

Since the antiferroelectric liquid crystal has the hysteresis nature in the transmitted light versus voltage characteristic, when a pulse wave is applied to a liquid crystal molecule, the ferroelectric state as the first stable state is selected if the product of the pulse width and the voltage exceeds the threshold value, the ferroelectric state as the second stable state is selected based on the polarity of the applied voltage in accordance with the difference in the polarity of the applied voltage, and, from these first and second states, the antiferroelectric state as the third stable state is selected if the absolute value of the product of the pulse width and the voltage is lower than a predetermined threshold value. The structure of the electrode of the matrix type liquid crystal panel including an antiferroelectric liquid crystal is shown in FIG. 2. The time-divisional driving is carried out by applying successively and periodically the selection signals to the scanning electrodes Y1 to Y128, applying predetermined information signals in parallel to the signal electrodes X1 to X16 in synchronization with the scanning electrode signal, and switching the liquid crystal molecules of the selected pixels in accordance with the display information. For example, the methods illustrated in FIG. 3 and FIG. 4 are proposed for the time-divisional driving. In the drivings illustrated in FIG. 7 and FIG. 8, even if the same display is displayed for a long period, no residual imaging of the preceding picture occurs, so that a satisfactory display can be realized.

Figure 9:
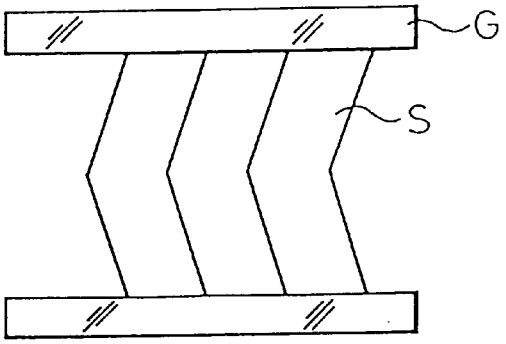
Fig. 9 PRIOR ART
FIGS. 9, 10, and 11 show examples of the layer structure of an antiferroelectric liquid crystal.
Figure 10:
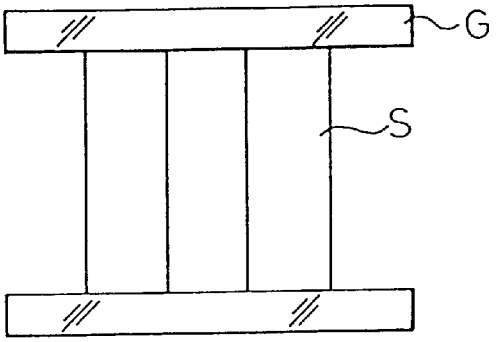
Fig.10 PRIOR ART
Figure 11:
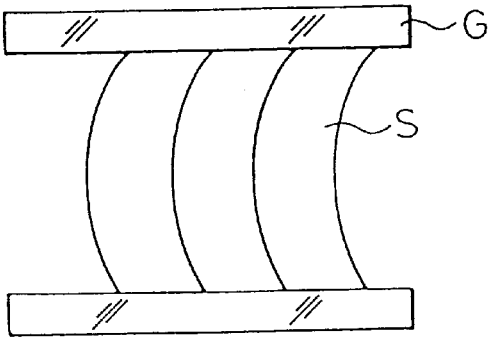
Fig.11 PRIOR ART

Examples of the layer structure of the antiferroelectric liquid crystal are shown in FIG. 9, FIG. 10, and FIG. 11. The antiferroelectric liquid crystal between the glass substrates G has the layer structure due to the smectic layer S, in which, in the antiferroelectric liquid crystal state before applying the voltage, the normal line of the substrate and the normal line of the layer are arranged not to be orthogonal in the cell to form a chevron structure in which the layers are bent in the cell (FIG. 9). In the ferroelectric liquid crystal state after applying the voltage, the book-shelf type layer structure is formed in which the normal of the substrate is orthogonal to the normal of the layer (FIG. 10), and after that when the state becomes again the antiferroelectric state, the layer structure is different from that in the beginning antiferroelectric liquid crystal state (FIG. 11). This is described in, for example, the publication OYO BUTSURI, vol. 50, No. 10. Therefore, in the prior art driving method, if the same display is displayed for a long period, both the pixels which are in the ferroelectric liquid crystal state and the pixels which are never in the ferroelectric state will exist. Accordingly, when these pixels are switched again to the antiferroelectric state, different layer structures of the liquid crystal appear in the plurality of pixels. This is because the plurality of pixels have different layer structures shown in FIG. 9 and FIG. 11. Due to this, there occurs different light transmittance, which cause the viewing of the residual image.

Figure 1:
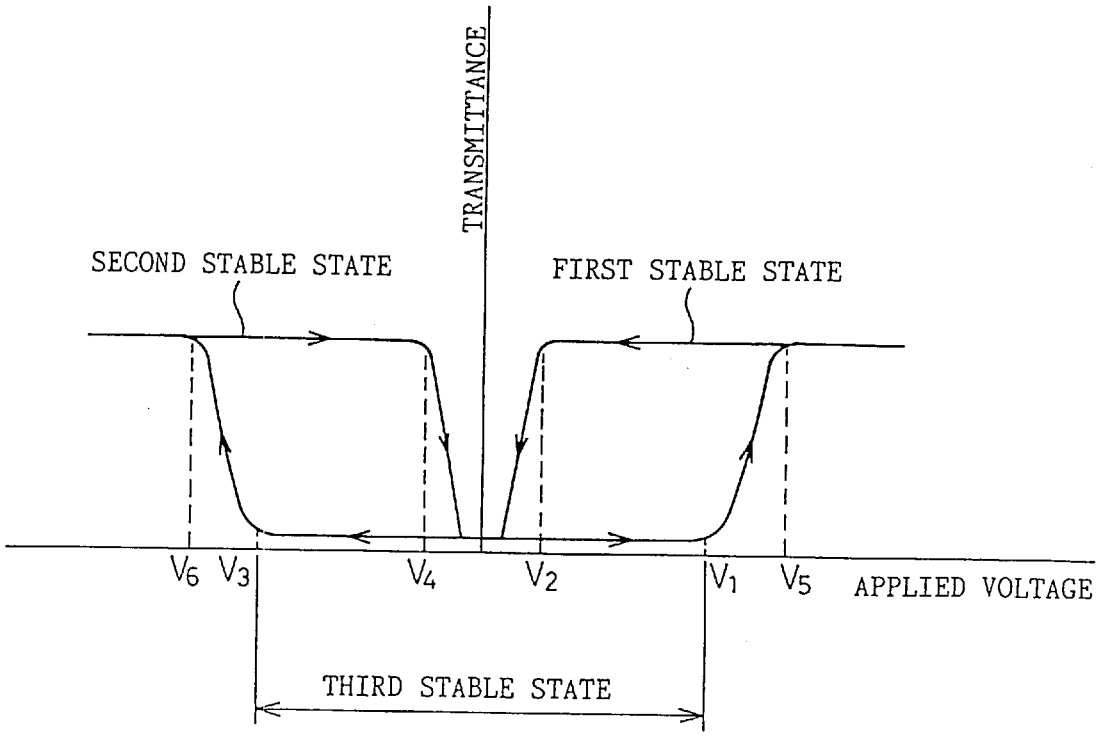
FIG. 1 shows an example of the light transmittance versus applied voltage characteristic of an antiferroelectric liquid crystal panel.

Examples of the operations in the driving method of the antiferroelectric liquid crystal display are illustrated in FIG. 1. In the operations illustrated in FIG. 1, the actual driving of the antiferroelectric liquid crystal panel consists of two scanning periods, and each scanning period has at least two period, i.e. the selection period and the non-selection period. The level Vu of the upper limit of the pulse wave applied during the non-selection period is set in the range $V2 \leqq Vu \leqq V1$, where V1 is the voltage at which the transmittance starts increasing in the case where the voltage, having the same polarity as the pulse width, is increased, and V2 is the voltage at which the transmittance starts decreasing in the case where the voltage is decreased. Also the level Vd of the lower limit of the pulse wave is set in the range $V3 \leqq Vd \leqq V2$, where V3 is the voltage at which the transmittance start increasing in the case where the absolute value of the voltage having the polarity opposite to that of the voltage V1 is increased.

In the non-selection period, the three stable states set in the selection period must be maintained. For example, in the first stable state, the voltage applied during the non-selection period is required to be higher than the hysteresis loop voltage V2 and lower than the voltage V1. In the case of the first stable state, when the voltage of the subsequently applied pulse wave is lower than V2 and higher than V3, the state is changed to the third state. If, after this pulse wave of the voltage lower than V2 and higher than V3, the pulse wave of the voltage between V1 and V2 is applied in the period sufficiently shorter than the period necessary for the liquid crystal molecule to return to the third stable state, it is proved that no return from the first stable state to the third stable state occurs. Since, in the usual antiferroelectric liquid crystal, the period to switch from the first or second stable state to the third stable state is longer than that from the third stable state to the first or second state, the pulse width of one pulse applied under the non-selection condition is too short to switch from the first stable state to the third stable state.

In the prior art, when, for example, the first stable state is selected, since the range of the voltage applied under the non-selection condition is required to be higher than V2 and lower than V1, the range of the voltage was limited. In the operation illustrated in FIG. 1, since the range of the lower limit of the voltage applied under the non-selection condition is required simply lower than V1 and higher than V3, the range of the voltage can be extended. For example, in the case of FIG. 1, if the inequality $|V1-V2| \geqq |V2-V4|$ is realized, when the holding voltage under the non-selection condition for the scanning side voltage is V2, the upper limit voltage of the pulse wave during the non-selection period can be increased up to V1, and the lower limit voltage can be the value: $V2-(|V1-V2|)$, and accordingly the width of the signal side voltage can be wider than that in the prior art.

In the time-divisional driving, the smaller the difference is between the absolute value of the selection pulse applied during the selection period of the scanning side voltage waveform and the absolute value of the signal side voltage waveform, the larger is the difference between the voltage of the pulse wave applied to the pixel in the selection of the ON state and that in the selection of the OFF state, to facilitate to drive the liquid crystal material which does not have sharp rising and falling characteristic of the hysteresis loop. Accordingly, the greater the absolute value of the signal side voltage, the more satisfactory the driving. In the operation illustrated in FIG. 1, the absolute value of the signal side voltage can be increased so that the satisfactory display for various kinds of the liquid crystal material can be easily carried out.

Figure 15:
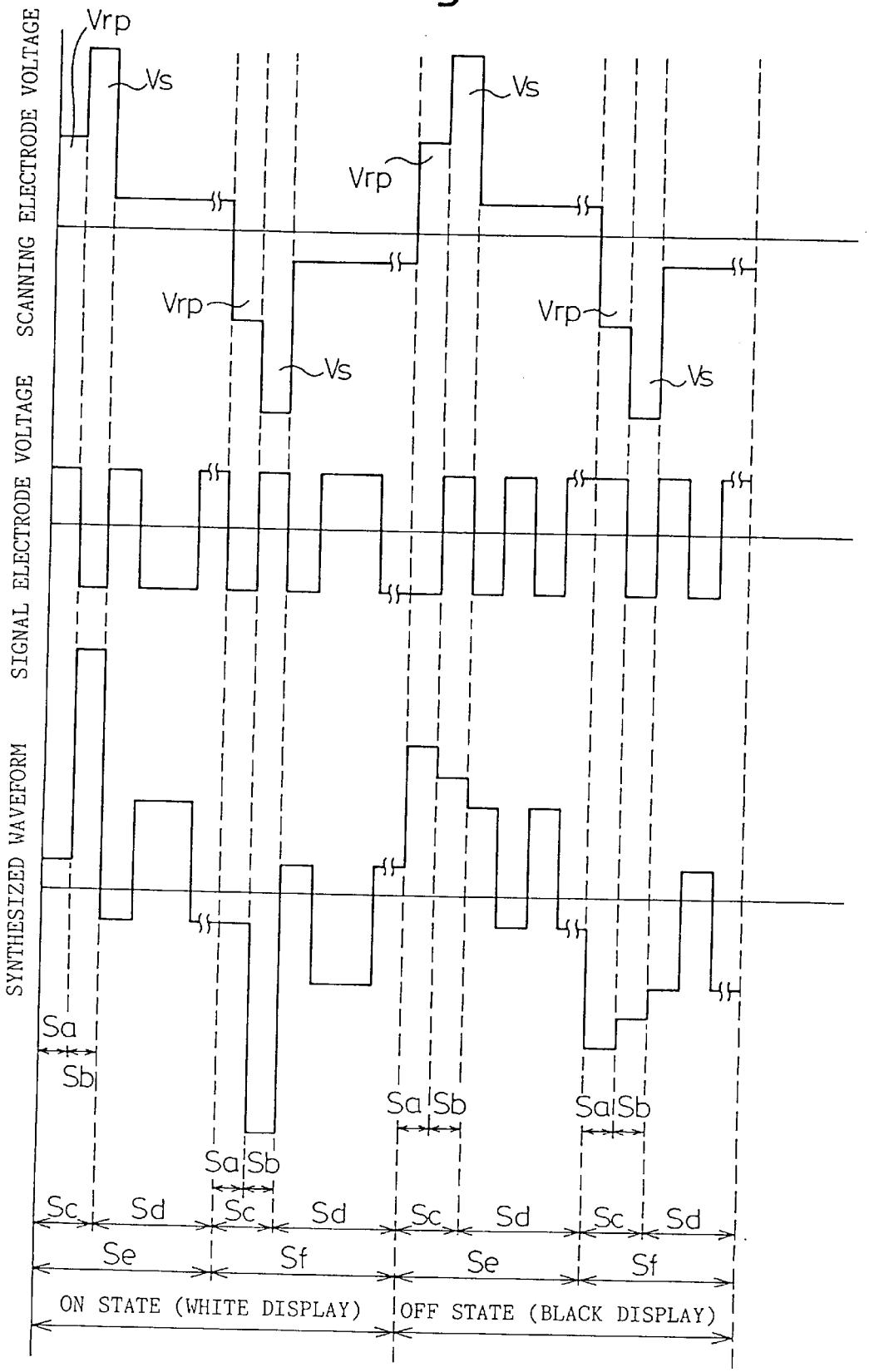
FIG. 15 illustrates a driving method in the technique according to an embodiment of the invention.
Figure 16:
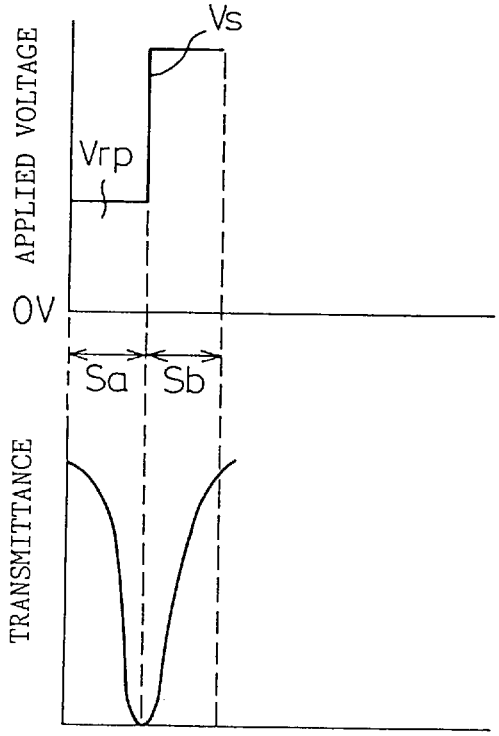
FIG. 16 illustrates the relationship between the voltage applied to the scanning electrode and the light transmittance.

As an example of the operation illustrated in FIG. 1, the antiferroelectric liquid crystal has the characteristic of the hysteresis loop shown in FIG. 1 where V1=18V, V2=4V, V3=−18V, V4=−4V, V5=30V, and V6=−30V. The driving waveform using this antiferroelectric liquid crystal is shown in FIG. 15. The driving waveform consists of 2 scanning periods, and one selection period is constituted by 4 pulses. The voltages in the first scanning period and the second scanning period are symmetrical to each other with regard to 0 volt. Each pulse has the width of 100 $\mu$s. In the first scanning period, the voltages applied to the scanning for the first to the third phases of the selection period are 0 volt, and that for the fourth phase is 30V, and, in the remaining non-selection period, the waveform of 4.5V is applied as the holding voltage. In the second scanning period, the applied voltages for the first to the third phases of the selection period are 0 volt, and that for the fourth period is −30V, and, in the remaining non-selection period, the waveform of −4.5V is applied as the holding voltage. To the signal side electrode, in the ON state, the voltage waveforms of 0 volt for the first and the second phases, 12V for the third phase, and −12V for the fourth phase are applied in synchronization with the scanning electrode side. Also, in the OFF state, the voltage waveforms of 0 volt for the first and the second phases, −12V for the third phase, and 12V for the fourth phase are applied. The driving was carried out with the frame frequency of approximately 60 ms. Accordingly, the signal side voltage can be set higher than that in the prior art, and the holding voltage of the scanning side voltage under the non-selection condition can be set lower, so that a satisfactory display can be carried out.

Figure 12:
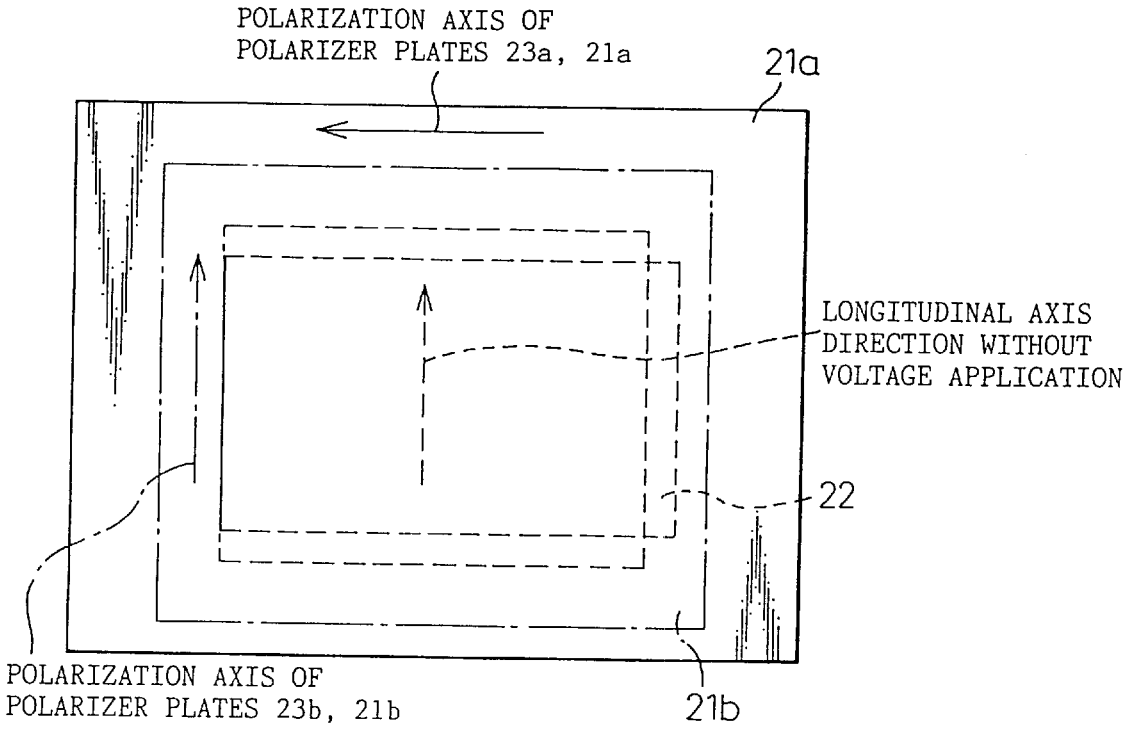
FIG. 12 shows the structures of the liquid crystal panel and a polarizer plate corresponding to the operations in the driving method.
Figure 13:
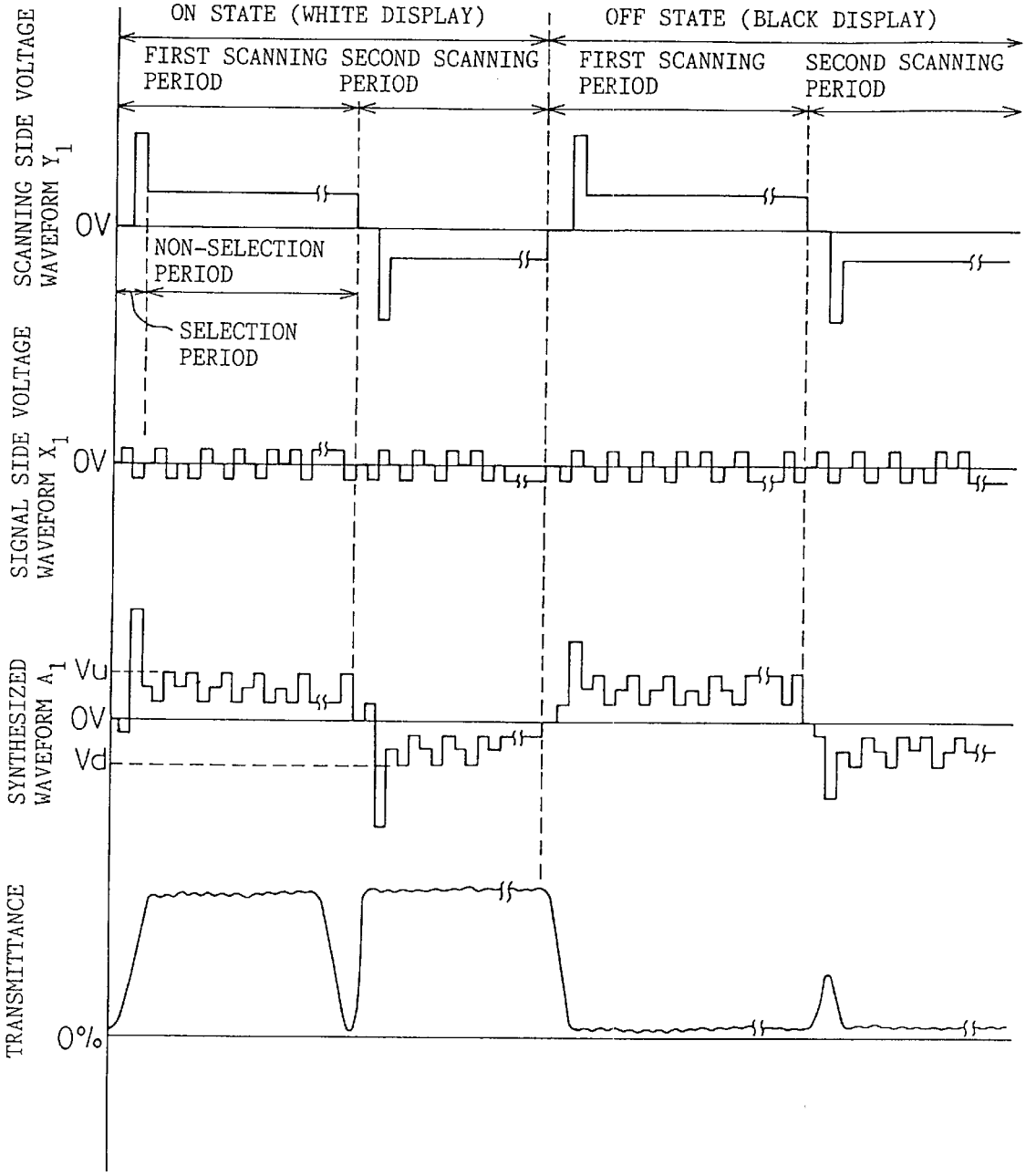
FIG. 13 shows the driving waveform of the prior art to be compared with the driving waveform in the technique according to an embodiment of the invention.

The constitution of the antiferroelectric liquid crystal as used as a display is shown in FIG. 12. The liquid crystal 22 is arranged between the polarizer plates 21*a* and 21*b* aligned with the cross Nicol prism in the manner that the polarization axis of either polarizer plate is parallel with the longitudinal axis direction of the molecule without voltage application, so that black is displayed when no voltage is applied and white when a voltage is applied. The characteristic of such cell structure regarding the applied voltage versus the transmittance change is expressed by the hysteresis loop shown in FIG. 1, in which V1 is the voltage at which the transmittance starts changing as the applied voltage is increased, V5 is the voltage at which the transmittance change is saturated, V2 is the voltage at which the transmittance starts changing as the applied voltage is decreased, V3 is the voltage at which the transmittance starts changing as the absolute value of the voltage having the polarity opposite to that of the above-mentioned voltage is applied, V6 is the voltage at which the transmittance change is saturated, and V4 is the voltage at which the transmittance starts changing as the absolute value of the voltage is decreased. As will be understood from FIG. 1, in the application of a pulse wave to the liquid crystal molecule, if the product of the pulse width and the voltage exceeds the threshold voltage, the ferroelectric state as the first stable state is selected, the ferroelectric state as the second stable state is selected depending on the polarity of the applied voltage, and if the absolute value of the product of the pulse width and the voltage is lower than a predetermined threshold value based on the first and the second state, the antiferroelectric state as the third stable state is selected.

Figure 14:
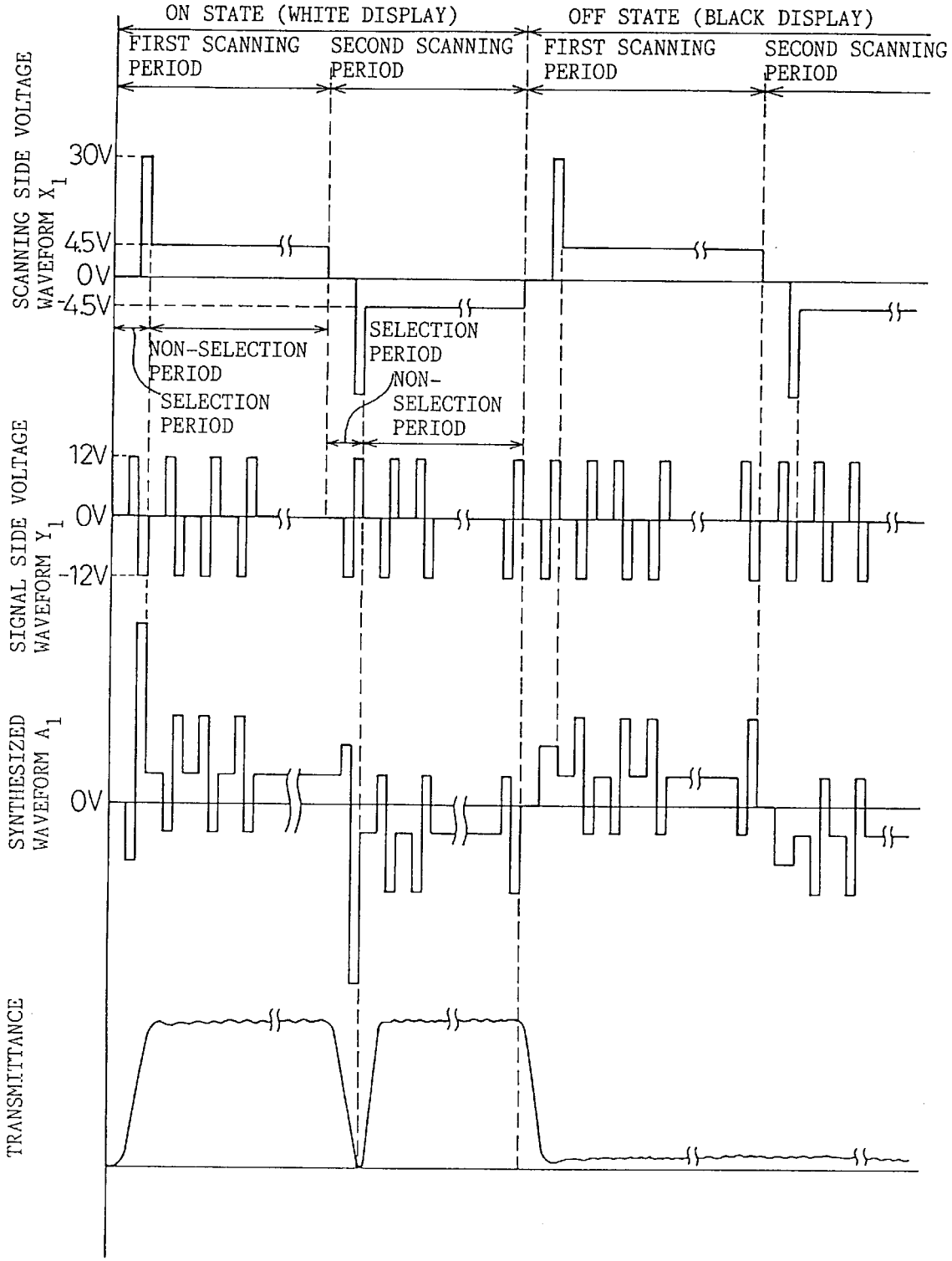
FIG. 14 shows the driving waveform in the technique according to an embodiment of the invention.

Various methods have been proposed for the time-divisional driving method. The constitution of the electrode of the matrix type liquid crystal panel including an antiferroelectric liquid crystal is shown in FIG. 2. The time-divisional driving in which the selection voltages are successively and periodically applied to the scanning electrodes Y1 to Y128, predetermined information signals are applied in parallel to the signal electrodes X1 to X160 in synchronization with the scanning electrode signals, and the liquid crystal molecules of the selected pixel are switched in accordance with the display information. In the driving method illustrated in FIG. 14, the writing of two scanning periods is carried out to write one picture, and the voltages of the waveforms in the first and the second scanning periods are symmetrical each other with regard to 0 volt, so that the realization of the alternation is intended. The changes in the voltage waveform and the transmittance of the pixel when the ON state and the OFF state of the pixel portion A1 in the arrangement of FIG. 2 is illustrated in FIG. 14. In the selection period, the signal applied to the scanning electrode Y1 consists of three phases, in which in the first phase the state is necessarily reset once to the OFF state as the antiferroelectric state, in the second phase the state in the first phase is maintained, and in the third phase the selection whether or not the state is set to the ON state as the ferroelectric state is carried out. If the third phase exceeds the threshold voltage for setting the ferroelectric state, the state is set to the ON state as the ferroelectric state, and if the third phase does not exceed this threshold voltage, the state is maintained in the OFF state as the antiferroelectric state.

In this case, the voltage in the non-selection period for the time-divisional driving is set lower than the voltage V1 at which the transmittance starts changing as the applied voltage illustrated in FIG. 1 is increased, and higher than V2 at which the transmittance starts changing as the absolute value of the applied voltage is decreased.

To carry out satisfactory time-divisional driving, when the scanning side voltage is $V_C$ and the signal side voltage is $V_D$, regarding the first scanning period, the inequalities $|V_C|+|V_D| \geqq V5$ and $0 \leqq ||V_C|-|V_D|| \leqq V1$ are required to be satisfied. Therefore, since the time-divisional driving is carried out in general under the condition $V_C > V_D$, if the liquid crystal material having a large difference between V1 and V5, the range of the value $V_D$ is considerably limited. Thus, if the liquid crystal material has a large difference between V1 and V5, the range of setting the voltage is considerably limited, and accordingly the satisfactory display is difficult to be carried out. In the driving method according to an embodiment of the present invention, by setting the range of the voltage in the non-selection period broader than that in the prior art case, the driving of the antiferroelectric liquid crystal capable of the satisfactory display, even for liquid crystal materials having a large difference between V1 and V5, is realized. In the driving method according to an embodiment of the present invention, for the antiferroelectric liquid crystal display, satisfactory display is easily carried out without being affected by the characteristic of the antiferroelectric liquid crystal material used.

A method for driving an antiferroelectric liquid crystal element according to an embodiment of the present invention is illustrated in FIG. 15. In the method illustrated in FIG. 15, at least the first scanning period and the second scanning period are arranged, the waveforms of the voltages in the first scanning period and the second scanning period are symmetrical with regard to 0 volt, and each of the first scanning period and the second scanning period has the selection period and the non-selection period. In the first phase of the selection period a reset pulse is applied to the scanning electrode, and in the second phase of the selection period a select pulse is applied to the scanning electrode. The polarity of the voltage of the reset pulse is the same as the polarity of the threshold voltage which changes the state from the one ferroelectric state of the state before the selection period to the other ferroelectric state. The absolute value of the voltage of the reset pulse is smaller than the absolute value of the threshold voltage and larger than 0 volt, and the polarities of the reset pulse and the select pulse in the same selection period are the same.

As shown in FIG. 1, in the case where the switching of the antiferroelectric liquid crystal from the ferroelectric state as the first stable state to the ferroelectric state as the second stable state is carried out, high speed switching can be attained by applying the voltage having the absolute value higher than the threshold voltage V6 and the same polarity as that of the threshold voltage V6. In the case where the antiferroelectric liquid crystal is switched from the second stable state to the first stable state, a high speed switching can be carried out by applying the voltage having the absolute value higher than the threshold voltage V5 and the same polarity as the threshold voltage V5. In this case, the liquid crystal molecule necessarily passes through the antiferroelectric state as the third stable state during the transfer from the one ferroelectric state as the first or the second stable state to the other ferroelectric state as the second or the first stable state. It has been proved that, if the voltage having the same polarity as the threshold voltages V5 and V6 and the absolute value lower than those of the threshold values V6 and V5 and higher than 0 volt, the liquid crystal molecule can not safely transfer to the first or the second stable state and subsequently transfers to the antiferroelectric state as the third stable state.

To carry out a high speed switching from the ferroelectric state as the first stable state to the antiferroelectric state as the third stable state by utilizing this phenomena, a voltage having the same polarity as the threshold voltage V6 required for switching to the other ferroelectric state as the second stable state and the absolute value lower than that of the threshold voltage V6 and higher than 0 volt is to be applied. Similarly, to carry out a high speed switching from the ferroelectric state as the second stable state to the antiferroelectric state as the third stable state, a voltage having the same polarity as the threshold voltage V5 required for switching to the other ferroelectric state as the first stable state and the absolute value lower than that of the threshold voltage V5 and higher than 0 volt is to be applied. Due to this, the state of the liquid crystal molecule stops at the antiferroelectric state so that a high speed switching from the ferroelectric state as the first or the second stable state to the antiferroelectric state as the third stable state can be carried out. In this method, the reset pulse Vrp is applied as above. Accordingly, the polarity of the select pulse Vs for setting from the antiferroelectric state of the first phase Sa to the ferroelectric state or the antiferroelectric state as the next state is the same as that of the reset pulse Vrp.

The waveforms of the voltage in the case of setting the ON state for the white display and the OFF state for the black display are shown in FIG. 15. The writing of one picture is carried out in the first scanning period Se and the second scanning period Sf. The waveforms in the first scanning period Se and the second scanning period are symmetrical each other with regard to 0 volt. Each of the first scanning period Se and the second scanning period Sf consists of the selection period Sc and the non-selection period Sd. The selection period is constituted by the first phase Sa and the second phase Sb. The reset pulse Vrp is applied in the first phase Sa to the scanning period, and the select pulse Vs is applied in the second phase Sb.

In the case where the ferroelectric state, i.e. the white display state, is maintained, the first or the second stable state of the stable state is different for each of the scanning periods Se and Sf. However, if the state immediately preceding the selection period Sc is the first stable state, a high speed resetting to the antiferroelectric state can be carried out by making the polarity of the reset pulse Vrp to be the same as that of the threshold voltage V6 to the second stable state, and making the voltage of the reset pulse Vrp to satisfy the inequality $|V6|>|Vrp|>0$. If the state immediately preceding the selection period is the second stable state, a high speed resetting to the antiferroelectric state can be carried out by making the polarity of the reset pulse Vrp to be the same as that of the threshold voltage V5 to the first stable state, and making the voltage of the reset pulse Vrp satisfy the inequality $|V5|>|Vrp|>0$. If the state immediately preceding the selection period is the antiferroelectric state, since the voltage of the reset pulse Vrp lies in the above-mentioned range, the voltage of the reset pulse does not exceed the threshold voltage V5 or V6, so that no switching to the ferroelectric state takes place. Accordingly, regardless of the state preceding immediately to the selection period Sc, the complete resetting to the antiferroelectric state is carried out in the period of the first phase which is the period for applying the reset pulse Vrp, so that the frequency of the frame frequency can be enhanced. Also, due to this, driving at the video rate without a delay in the writing of the picture can be carried out.

The relationship between the voltage applied to the scanning electrode and the light transmittance in the selection period Sc of the ON state for the white display is illustrated in FIG. 10. The selection period is constituted by the first phase Sa and the second phase Sb. In the first phase Sa the reset pulse Vrp is applied, and in the second phase Sb the select pulse Vs is applied. The state immediately preceding the selection period Sc is the ferroelectric state. In this embodiment, since the complete resetting to the antiferroelectric state is carried out in the period of the first phase Sa, the light transmittance is sufficiently low immediately before applying the select pulse Vs.

Figure 17:
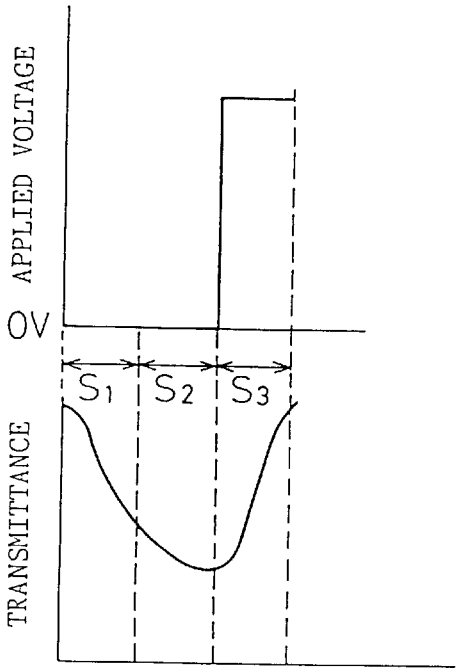
FIG. 17 illustrates the relationship between the voltage applied to the scanning electrode and the light transmittance.

As a comparison, the relationship between the voltage applied to the scanning electrode and the light transmittance in the prior art driving method is shown in FIG. 17. As shown in FIG. 17, no sufficient resetting to the antiferroelectric state is carried out in the period of the first phase S1 and the second phase S2 of the selection period S4.

The relationship between the applied voltage and the light transmittance of the liquid crystal panel in this embodiment is shown in FIG. 1 in which the threshold voltage V5 is 40V, and the threshold voltage V6 is −40V.

The reset pulse Vrp is applied to the scanning electrode in the first phase Sa, and the select pulse Vs is applied to the second phase Sb. The voltage of the reset pulse Vrp in the first scanning period Se is set to 18V, the voltage of the select pulse Vs is set to 30V, and the holding voltage in the non-selection period Sd is set to 4.5V, regarding both the ON state for the white display and the OFF state for the black display. The voltage of the reset pulse Vrp in the second scanning period Sf is set to −18V, the voltage of the select pulse Vs is set to −30V, and the OFF setting voltage in the non-selection period Sd is set to −4.5V, regarding both the ON state for the white display and the OFF state for the black display.

The voltage synchronized with the applied voltage for the scanning electrode is applied to the signal electrode. The conditions are set such that, the voltage 12V is applied in the first phase Sa of the first scanning period Se in the ON state for the white display, the voltage −12V is applied in the second phase, the voltage −12V is applied in the first phase Sb of the second scanning period Sf, and the voltage 12V is applied in the second phase Sb. Also, the conditions are set such that, the voltage −12V is applied in the first phase Sa of the first scanning period Se in the OFF state for the black display, the voltage 12V is applied in the second phase, the voltage 12V in the first phase Sa of the second scanning period Sf, and the voltage −12V is applied in the second phase Sb.

Each pulse width is set to 100 $\mu$s. As a result, the driving with a frame frequency of approximately 15 ms becomes possible, the frame frequency becomes much higher than in the case of prior art, and satisfactory driving becomes possible even with the frequency of the video rate. Thus, in this embodiment, a high speed, complete resetting to the antiferroelectric state in the selection period can be carried out.

Figure 18:
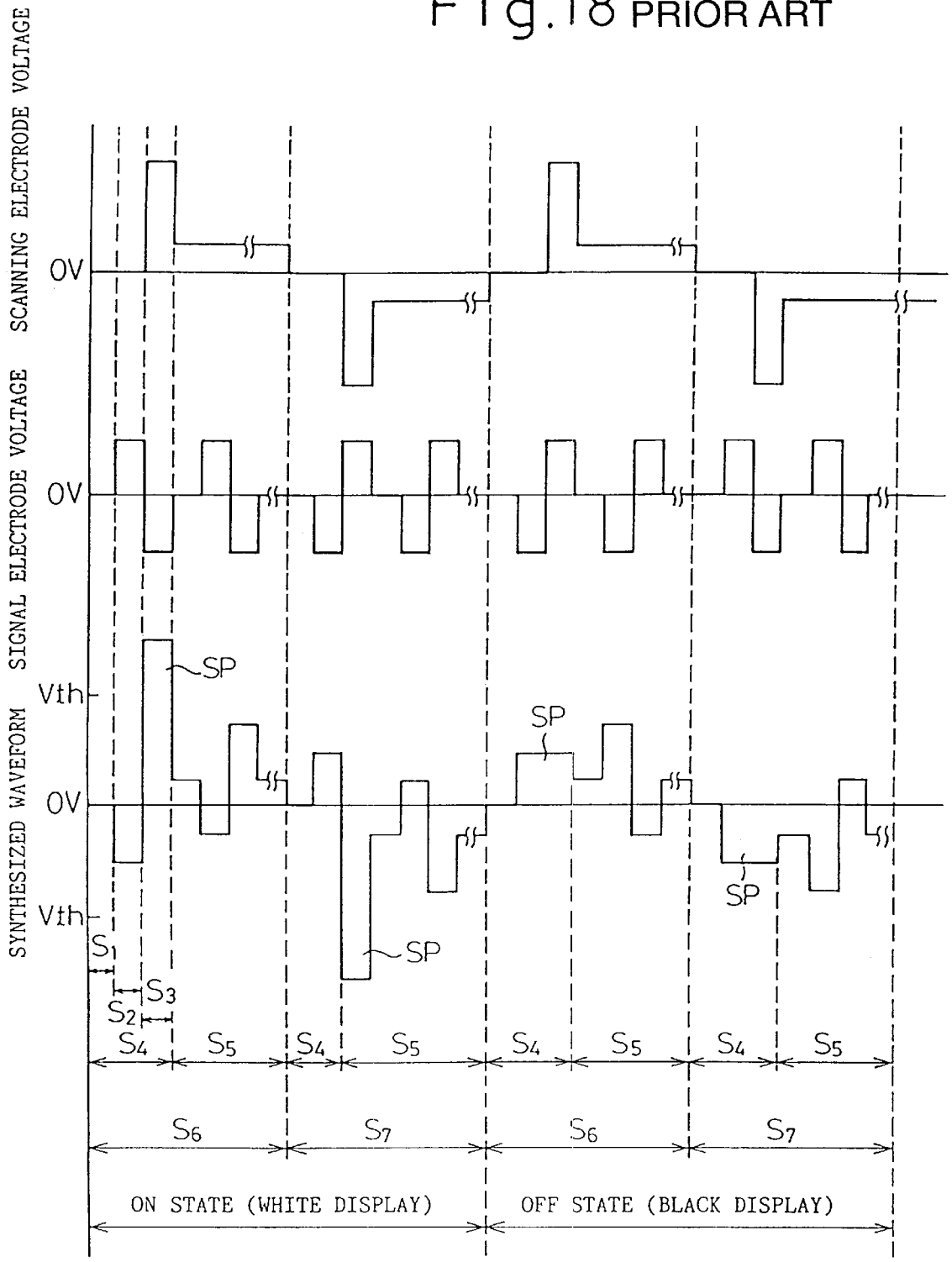
Fig.18 PRIOR ART
FIG. 18 illustrates an example of the prior art time-divisional driving method of a liquid crystal element.

Various methods for time-divisionally driving the antiferroelectric liquid crystal element have been proposed as prior arts, and an example thereof is illustrated in FIG. 18. In FIG. 18, the waveform of the voltage for setting the ON state for the white display and the OFF state for setting the black display. In this driving method, the writing of one picture is carried out in two scanning periods S6 and S7. The voltage waveforms in the first scanning period S6 and the second scanning period S7 are symmetrical each other with regard to the voltage 0 volt, so that the alternating effect is intended to be attained by the writing in the two scanning periods S6 and S7. Each of the first scanning period S6 and the second scanning period S7 consists of the selection period S4 and the non-selection period S5. The voltage applied in the selection period S4 consists of three phases: the first phase S1, the second phase S2, and the third phase S3. The synthesized waveform of the voltage applied to the scanning electrode and the voltage applied to the signal electrode is as shown in FIG. 18, in which the resetting to the OFF state as the antiferroelectric state is necessarily carried out in the first phase S1, the maintenance of the state of the first phase S1 is carried out in the second phase S2, and the selection whether or not the state is set to the ON state as the ferroelectric state is carried out by the select pulse SP in the third phase S3. If the select pulse SP in the third phase S3 exceed the threshold voltage Vth for setting to the ferroelectric state, the state is set to the ON state as the ferroelectric state, and if it does not exceed the threshold voltage, the OFF state as the antiferroelectric state is maintained.

Figure 19:
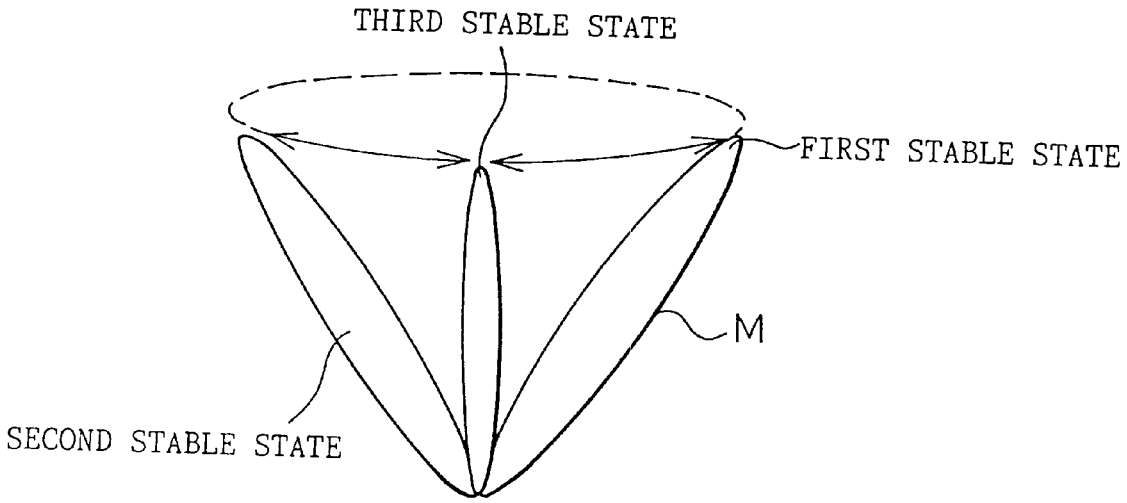
FIG. 19 illustrates the state of a liquid crystal molecule.

The state of the liquid crystal molecule of the antiferroelectric liquid crystal is illustrated in FIG. 19. As illustrated in FIG. 19, the liquid crystal molecule M of the antiferroelectric liquid crystal has three stable states. In the case where no voltage is applied, the state is in the third stable state as the antiferroelectric state, and if the voltage higher than the threshold voltage is applied, the switching to the ferroelectric state as the first stable state or the ferroelectric state as the second stable state is carried out depending on the polarity of the applied voltage. In the prior art driving method shown in FIG. 18, the applied voltage is made 0 volt to switch from the ferroelectric state to the antiferroelectric state. That is, it is arranged that the switching takes place based on the nature, e.g. viscosity, of the molecule itself of the liquid crystal without exerting an external force on the antiferroelectric liquid crystal. Accordingly, the response speed from the ferroelectric state to the antiferroelectric state is very low.

Figure 20:
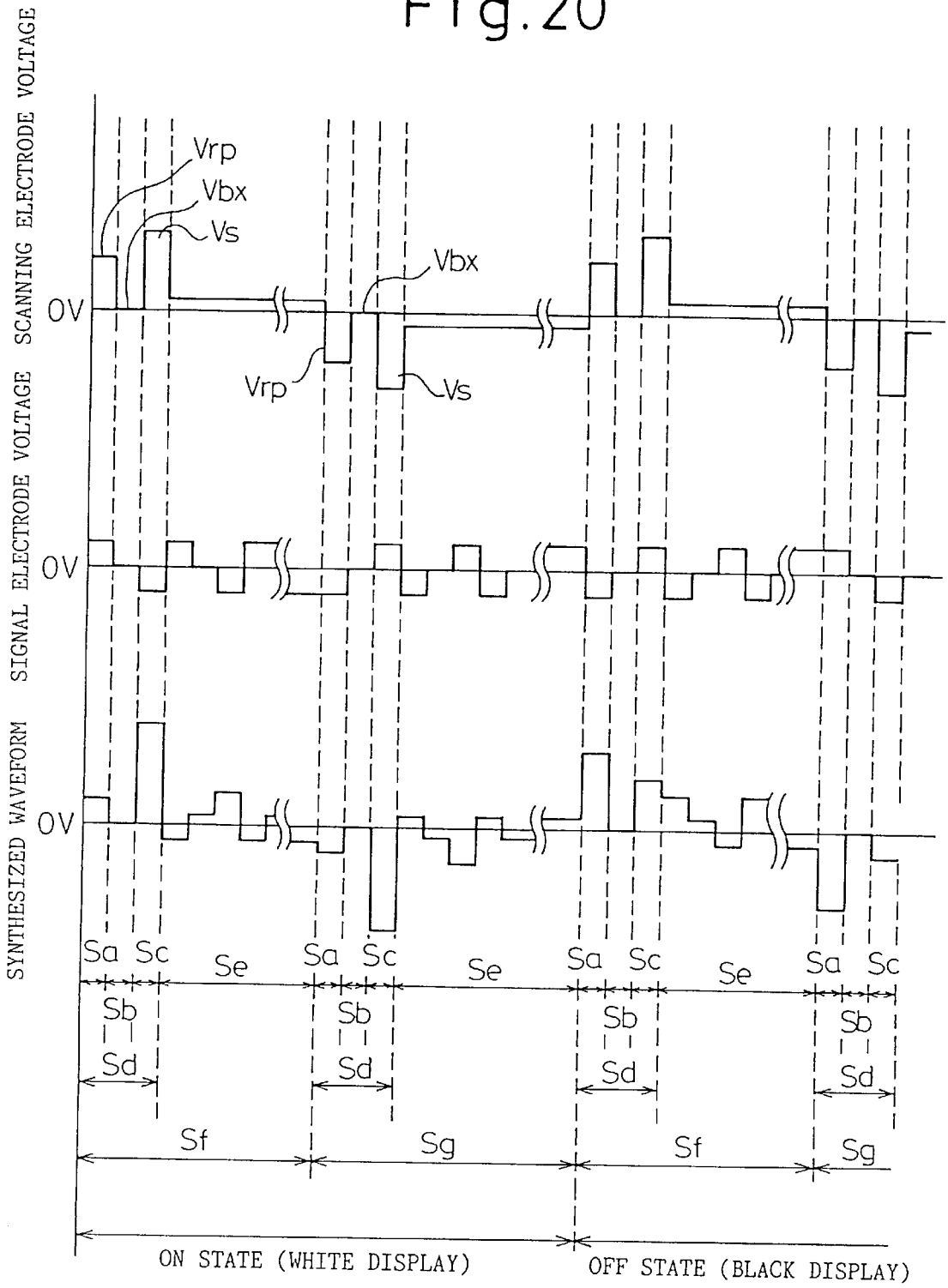
FIG. 20 illustrates the driving method of a liquid crystal element in the technique according to an embodiment of the invention.

In the driving method illustrated in FIG. 18, the resetting to the antiferroelectric state is necessarily carried out in the first half of the first phase S1 of the selection period S4, and after that the selection whether the state is to be made the ferroelectric state or the antiferroelectric state is carried out by the select pulse SP of the third phase S3. However, as described above, the response speed from the ferroelectric state to the antiferroelectric state of the antiferroelectric liquid crystal is low. Accordingly, if the first phase S1 as the period for the resetting is short, the complete antiferroelectric state cannot be realized, so that the satisfactory display cannot take place. Therefore, the selection period S4 is required to be sufficiently long and, accordingly, the frame frequency cannot be high. As a result, the speed of writing the picture plane becomes slow, so that the driving at the video rate becomes difficult. The relationship between the deflection axis of the antiferroelectric liquid crystal element and the average longitudinal axis direction of the liquid crystal molecule is illustrated in FIG. 20. In the method illustrated in FIG. 20, there are provided at least the first scanning period and the second scanning period, the voltage waveforms in the first scanning period and the second scanning period are symmetrical each other with regard to 0 volt, each of the first scanning period and the second scanning period has at least the selection period and the non-selection period, the selection period has the first, the second, and the third phases, the reset pulse is applied to the scanning electrode in the first phase of the selection period, the base voltage is applied to it in the second phase, the select pulse is applied to it in the third phase, the polarity of the voltage of the reset pulse is the same as that of the threshold voltage for changing from the one ferroelectric state at the time immediately preceding the selection period to the other ferroelectric state, the absolute value of the voltage of the reset pulse is lower than the absolute value of the threshold voltage and higher than 0 volt, and the voltage Vbx of the base voltage is given by the inequality V3<Vbx<V1. In this case, V1 is the voltage at which the light transmittance starts increasing when a positive voltage is applied to the antiferroelectric liquid crystal element, V3 is the voltage at which the light transmittance starts increasing when a negative voltage is applied to the antiferroelectric liquid crystal element, and the polarity of the reset pulse and the polarity of the select pulse in the same selection period are the same. Preferably, the base voltage applied in the second phase of the selection period is 0 volt.

To switch at a high speed from the ferroelectric state as the first stable state of the liquid crystal molecule of the antiferroelectric liquid crystal shown in FIG. 1 to the antiferroelectric state as the third stable state, the reset pulse Vrp having a polarity the same as the polarity of the threshold voltage V6 required for switching to the ferroelectric state as the other second stable state and having the voltage which has the absolute value lower than that of the threshold voltage V6 and is higher than 0 volt is applied. To switch at a high speed from the ferroelectric state as the second stable state to the antiferroelectric state as the third stable state, the reset pulse Vrp having a polarity the same as the polarity of the threshold voltage V5 required for switching to the ferroelectric state as the other first stable state and having the voltage which has the absolute value lower than that of the threshold voltage V5 and is higher than 0 volt is applied.

In the driving method illustrated in FIG. 20, to transfer completely the state of the liquid crystal molecule which is moved into the vicinity of the ferroelectric state as the first or the second stable state to the antiferroelectric state as the third stable state, the base voltage Vbx is applied in the second phase after the reset pulse Vrp is applied. The base voltage Vbx is defined by the voltages V3 and V1 which are the voltages at which the light transmittance starts increasing and have the relationship V3<Vbx<V1, where V1 is the voltage at which the light transmittance starts increasing when a positive voltage is applied to the antiferroelectric liquid crystal element and V3 is the voltage at which the light transmittance starts increasing when a negative voltage is applied. The polarity of the base voltage may be optionally selected and may be the same as or different from that of the reset pulse Vrp. More preferably, the base voltage is 0 volt. In the technique of the present invention, regardless of the ferroelectric state or the antiferroelectric state of the state preceding to the selection period, the complete resetting of the liquid crystal molecule to the antiferroelectric state before applying the select pulse Vs in the third phase. In this regard, if the base voltage exceeds the above-mentioned range, the liquid crystal molecule will be transferred to the ferroelectric state.

Shown in FIG. 20 the waveforms of the voltages applied to the scanning electrode and the signal electrode and the synthesized waveform thereof when the displays of the ON state for the white display and the OFF state for the black display are set. In this embodiment, the writing of one picture is carried out in the first scanning period Sf and the second scanning period Sg. The voltage waveforms in the first scanning period Sf and in the second scanning period Sg are symmetrical with regard to 0 volt. Each of the first scanning period Sf and the second scanning period Sg is constituted by the selection period and the non-selection period. The selection period Sd is constituted by the first phase Sa, the second phase Sb, and the third phase Sc. The reset pulse Vrp is applied to the scanning electrode in the first phase Sa, the base voltage Vbx is applied in the second phase Sb, and the select pulse is applied in the third phase Sc.

In the case where the ferroelectric state for the white display is maintained, the stable state becomes a different stable state, i.e. either the first stable state or the second stable state, for each scanning period Sf or Sg. When the state immediately preceding the selection period Sd is the second stable state, the reset pulse Vrp having the polarity same as that of the threshold voltage V5 for the first stable state and having the voltage which satisfies the condition |V5|>|Vrp|>0 is applied. When the state preceding immediately to the selection period Sd is the first stable state, the reset pulse Vrp having the polarity same as that of the threshold voltage V6 for the second stable state and having the voltage which satisfies the condition |V6|>|Vrp|>0 is applied.

In the driving method illustrated in FIG. 20, the base voltage Vbx applied in the second phase Sb is made 0 volt to return the state of the liquid crystal molecule, which has been moved by the application of the reset pulse Vrp completely to the antiferroelectric state, as the third stable state. Thus, by applying the base voltage Vbx represented by the relationship V3<Vbx<V1 after the reset pulse Vrp is applied, the complete resetting to the antiferroelectric state can be carried out in the second phase Sb. Accordingly, the satisfactory high speed display can be carried out without depending on the display pattern.

Figure 21:
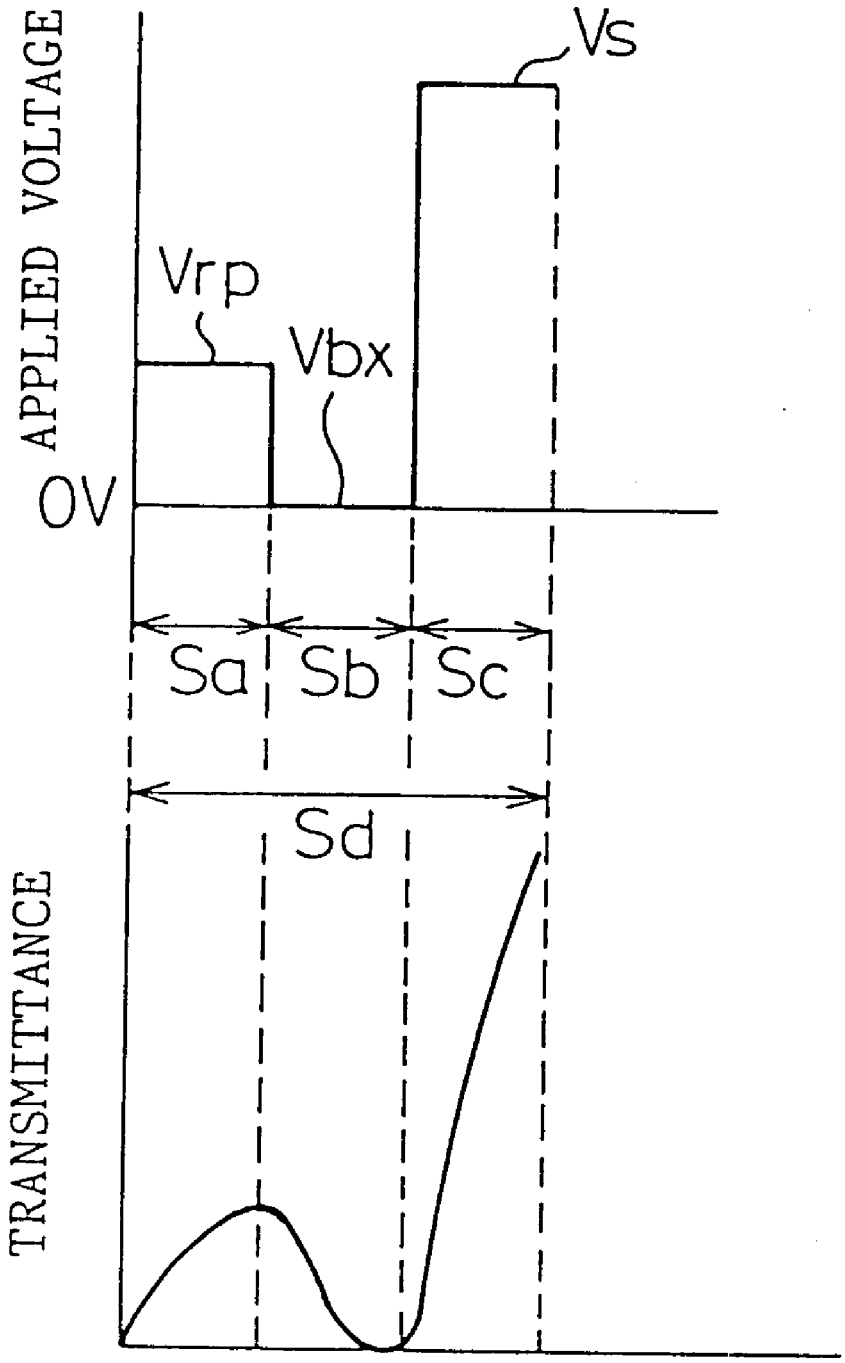
FIG. 21 shows the relationship between the voltage supplied to the scanning electrode and the light transmittance.

The relationship between the voltage applied to the scanning electrode and the light transmittance in the selection period Sd of the ON state for the white display is shown in FIG. 21. The state immediately preceding to the selection period Sd is the antiferroelectric state. It is possible to reset the liquid crystal molecule moved into the vicinity of the ferroelectric state as the first or the second stable state by the application of the reset pulse Vrp completely to the antiferroelectric state in the second phase Sb by applying the base voltage Vbx. Accordingly, the light transmittance can be made sufficiently low before the third phase Sc. The relationship between the applied voltage of the display panel and the light transmittance is shown in FIG. 1. The threshold voltage V5 is 40V, and the threshold voltage V6 is −40V.

The reset pulse Vrp is applied to the scanning electrode in the first phase Sa of the selection period Sd, the base voltage Vbx is applied in the second phase Sb, and the select pulse Vs is applied in the third phase Sc. In both the ON state for the white display and the OFF state for the black display, it is set that the voltage of the reset pulse Vrp in the first phase Sa of the first scanning period Sf is 18V, the base voltage is 0 volt, the voltage of the select pulse Vs is 30V, and the OFF setting voltage in the non-selection period Se is 4.5V. In both the ON state for the white display and the OFF state for the black display, it is set that the voltage of the reset pulse Vrp in the second scanning period Sg is −18V, the base voltage is 0 volt, the voltage of the select pulse Vs is −30V, and the holding voltage in the non-selection period Se is −4.5V.

The voltage synchronized with the voltage applied to the scanning electrode is applied to the signal electrode. It is set that 12V voltage is applied in the first phase Sa of the first scanning period Sf in the ON state for the white display, 0 volt voltage is applied in the second phase, −12V voltage is applied in the third phase Sc, −12V voltage is applied in the first phase Sa of the second scanning period Sg is applied, 0 volt voltage is applied in the second phase Sb, and 12V voltage is applied in the third phase Sc. It is set that −12V voltage is applied in the first phase Sa of the first scanning period Sf in the OFF state for the black display, 0 volt voltage is applied in the second phase Sb, and −12V voltage is applied in the third phase Sc. The width of each pulse is set to be 100 $\mu$m. Thus, the driving can be carried out with the frame frequency of approximately 15 ms, the frame frequency can be made fast compared with the case of the prior art, and the satisfactory display at the frequency of the video rate can be carried out. Also, regardless of the display pattern, a satisfactory high speed display can be carried out.

In the driving method according to an embodiment of the present invention illustrated in FIG. 20, the driving of the antiferroelectric liquid crystal element at the frame frequency of the video rate can be carried out. Also, regardless of the display pattern, a satisfactory high speed display can be carried out.

CAPABILITY OF EXPLOITATION IN INDUSTRY

The antiferroelectric liquid crystal panel and the driving method thereof according to the present invention can be exploited, for example, for the display panel, optical shutter array, and the like, using the antiferroelectric liquid crystal having the matrix forming pixels.

I claim:

1. A method for driving an antiferroelectric liquid crystal panel which holds an antiferroelectric liquid crystal between a pair of substrates having on opposite surfaces thereof a plurality of scanning electrodes and signal electrodes and has matrix-forming pixels, comprising:

providing one scanning period having a selection period for determining the state of a pixel and a non-selection period for holding the state of a pixel, and providing a pause period between one scanning period and the next scanning period, and making the pixels on all the scanning electrodes simultaneously in the antiferroelectric state during the pause period each time the display state of any of the pixels is changed.

2. An antiferroelectric liquid crystal display unit comprising:

an antiferroelectric liquid crystal between a pair of substrates having on opposite surfaces thereof a plurality of scanning electrodes and signal electrodes and having matrix-forming pixels, one scanning period having a selection period for determining the state of a pixel and a non-selection period for holding the sate of a pixel, and a pause period between the end of one scanning period and beginning of the next scanning period for making the pixels on all the scanning electrodes simultaneously in the ferroelectric liquid crystal state each time the display state of any of the pixels is changed.

3. A method for driving an antiferroelectric liquid crystal display unit which holds an antiferroelectric liquid crystal between a pair of substrates having on opposite surfaces thereof a plurality of scanning electrodes and signal electrodes and has matrix-forming pixels, characterized in that, the actual driving period of the liquid crystal unit is constituted by at least two scanning periods, each scanning period includes at least two periods: a selection period and a non-selection period, the voltage Vu of the upper limit of the pulse wave applied during the non-selection period is set in the range between the voltage V1 at which the transmittance starts increasing when a voltage having the same polarity as that of the pulse wave is applied to the antiferroelectric liquid crystal unit and the applied voltage is increased and the voltage V2 at which the transmittance starts decreasing when the applied voltage is decreased, i.e. $V2 \leqq Vu \leqq V1$, and the voltage Vd of the lower limit of the pulse wave is set in the range between the voltage V3 at which the transmittance starts increasing when the absolute value of the voltage having the polarity opposite to that of the voltage V1 is increased and the voltage V1, i.e. $V3 \leqq Vd \leqq V1$.

4. A method for driving an antiferroelectric liquid crystal element in which there are provided at least a first scanning period and a second scanning period, the voltage waveforms in said first and second scanning periods are symmetrical with regard to 0 volt, and each of said first and second scanning periods has at least a selection period and a non-selection period, characterized in that, a reset pulse is applied to the scanning electrodes in the first phase of said selection period, a select pulse is applied to the scanning electrodes in the second phase of said selection period, the polarity of the voltage of said reset pulse is the same as that of the threshold voltage for changing the one ferroelectric state preceding to said selection period to the other ferroelectric state, the absolute value of the voltage of said reset pulse is higher than 0 volt and lower than the absolute value of said threshold voltage, and the polarities of said reset pulse and said select pulse in said same selection period are the same.

5. A method for driving an antiferroelectric liquid crystal element in which there are provided at least a first scanning period and a second scanning period, the voltage waveforms in said first and second scanning periods are symmetrical with regard to 0 volt, and each of said first and second scanning periods has at least a selection period and a non-selection period, characterized in that, said selection period has a first phase, a second phase, and a third phase, a reset pulse is applied to the scanning electrodes in said first phase of said selection period, a base voltage is applied to the scanning electrodes in said second phase, a select pulse is applied to the scanning electrodes in said third phase, the polarity of the voltage of said reset pulse is the same as that of the threshold voltage for changing the one ferroelectric state preceding to said selection period to the other ferroelectric state, the absolute value of said reset pulse is higher than 0 volt and lower than the absolute value of said threshold voltage, and the voltage Vbx of said base voltage is given by the inequality: $V3<Vbx<V1$, where V1 is the voltage at which the transmittance starts increasing when a positive voltage is applied to the antiferroelectric liquid crystal element and V3 is the voltage at which the transmittance starts increasing when a negative voltage is applied thereto, and the polarities of said reset pulse and said select pulse in said same selection period are the same.

6. A method for driving an antiferroelectric liquid crystal element according to claim 5, wherein said base voltage is 0 volt.

7. An antiferroelectric liquid crystal display unit comprising:

an antiferroelectric liquid crystal between a pair of substrates having on opposite surfaces thereof a plurality of scanning electrodes and signal electrodes and having matrix-forming pixels, one scanning period having a selection period for determining the state of a pixel and a non-selection period for holding the state of a pixel, a pause period between one scanning period and the next scanning period for making the pixels on all the scanning electrodes simultaneously in the ferroelectric state, and a driving circuit connected electrically with the antiferroelectric liquid crystal panel and constituted by two circuits: a display drive waveform outputting circuit and a layer structure control outputting circuit for controlling in cell the layer structure of a smectic layer, and whereby a selection of the outputs of said two circuits is carried out.

8. A method for driving an antiferroelectric liquid crystal display unit comprising:

providing an antiferroelectric liquid crystal between a pair of substrates having on opposite surfaces thereof a plurality of scanning electrodes and signal electrodes and having matrix-forming pixels, providing a scanning period having a selection period for determining the state of a pixel and a non-selection period for holding the state of a pixel, and providing in the scanning period a reset period for causing the state of a pixel to be reset always to the ferroelectric state regardless of the current state of the pixel.

* * * * *